US006617972B2

(12) United States Patent
Takarada et al.

(10) Patent No.: US 6,617,972 B2
(45) Date of Patent: Sep. 9, 2003

(54) TABLE TAP AND MONITOR SYSTEM USING TABLE TAP

(75) Inventors: Shinichi Takarada, Ehime (JP); Hiromasa Mizuki, Ehime (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/959,349

(22) PCT Filed: Feb. 23, 2001

(86) PCT No.: PCT/JP01/01340

§ 371 (c)(1),
(2), (4) Date: Jan. 29, 2002

(87) PCT Pub. No.: WO01/63578

PCT Pub. Date: Aug. 30, 2001

(65) Prior Publication Data

US 2002/0158763 A1 Oct. 31, 2002

(30) Foreign Application Priority Data

Feb. 24, 2000 (JP) ..... 2000-048228

(51) Int. Cl.[7] ..... G08B 21/00

(52) U.S. Cl. ..... 340/635; 340/636.12; 340/656; 340/310.01; 702/62; 324/538

(58) Field of Search ..... 340/635, 636.12, 340/636.13, 636.15, 637, 656, 3.1, 870.11, 310.01, 310.08; 324/538, 141, 142, 103 R; 702/62, 64

(56) References Cited

U.S. PATENT DOCUMENTS 4,644,320 A 2/1987 Carr et al. ..... 340/310.01
4,990,893 A 2/1991 Kiluk ..... 340/573.1
5,589,764 A * 12/1996 Lee ..... 324/157
5,692,215 A 11/1997 Kutzik et al. ..... 395/838
6,429,642 B1 * 8/2002 Rodilla Sala ..... 324/142
6,476,729 B1 * 11/2002 Liu ..... 340/870.11
6,487,509 B1 * 11/2002 Aisa ..... 702/62

FOREIGN PATENT DOCUMENTS

| | | |
|---|---|---|
| EP | 0510677 | 10/1992 |
| GB | 2324183 | 10/1998 |
| JP | 2-226496 | 9/1990 |
| JP | 03150698 | 6/1991 |
| JP | 7-69995 | 7/1995 |
| JP | 10248093 | 9/1998 |

OTHER PUBLICATIONS

Patent Abstracts of Japan, vol. 1998, No. 14, Dec. 31, 1998 & JP 10 248093 A (Zojirushi Corp), Sep. 14, 1998.

* cited by examiner

*Primary Examiner*—Toan N Pham
(74) *Attorney, Agent, or Firm*—Wenderoth, Lind & Ponack L.L.P.

(57) ABSTRACT

An object of the invention is to provide a monitor system for detecting occurrence of abnormal situation on the elderly living alone and the like, by using an inexpensive table tap alone, without modifying an electric appliance and a plug which are currently used. A table tap (100) contains an ammeter (103), a judgement unit (104), and a communication unit (105). After connecting an electric appliance which is currently used to the table tap, when the judgement unit (104) decides that the power consumption detected by the ammeter (103) is unusual, the communication unit (105) notifies a base station (109) that an abnormal situation occurs.

63 Claims, 8 Drawing Sheets

| | | | | | | |
|---|---|---|---|---|---|---|
| 00H | 04H | | | | | 1201 |
| 01H | 7FH | 01H | 08H | 14H | | 1202 |
| 01H | 01H | 01H | 14H | 0AH | | 1203 |
| 02H | 7FH | 01H | 00H | 00H | | 1204 |
| 03H | 7FH | 01H | 05H | 1EH | 07H | 00H 1205 |

TABLE TAP AND MONITOR SYSTEM USING TABLE TAP

TECHNICAL FIELD

The present invention relates to a warning device for informing an abnormal situation by using a communication line. More particularly, the invention relates to a table tap and a monitor system using a table tap, for monitoring the daily life of the elderly living alone, the handicapped, or the like, and requesting a home help service or the like when it detects an abnormal situation.

BACKGROUND ART

A conventional life monitoring system is disclosed in, for example, Japanese Published Patent Application No. Hei.10-248093. In this system, each of electrical appliances is provided with a device for detecting the operating condition of the appliance, and signals detected by the respective devices are integrally managed by a centralized management means, and a request for home help service or the like is made through telephone line as necessary.

There is another system disclosed in, for example, Japanese Published Patent Application (amended) No. Hei.7-69995. In this system, a water meter and a watt-hour meter are provided with devices for measuring the amounts of consumed water and electricity by the whole household, and an abnormal situation is detected from the use of water and electricity, and a request for a home help service or the like is made through telephone line as necessary.

In the conventional system disclosed in Japanese Published Patent Application No. Hei.10-248093, however, the respective electrical appliances must be modified to add the devices for detecting their operating conditions, and the centralized management means for integrally managing these devices is required. Further, communication lines between the respective devices and the centralized management means are also required. Therefore, when introducing this system, it will be very costly to modify or change the electric appliances which are currently used. Especially, the elderly will be reluctant to change the electrical appliances they are accustomed to use.

On the other hand, in the conventional system disclosed in Japanese Published Patent Application (Amended) No. Hei.7-69995, the water meter and the watt-hour meter require construction work. Further, since information obtained from the use of electricity is only the total of use conditions of all electric appliances, if an appliance whose power consumption varies with time, such as a refrigerator or a kotatsu, is included, it is difficult to detect that an abnormal situation occurs.

The present invention is made to solve the above-described problems and has for its object to provide a table tap and a monitor system using a table tap, for detecting an abnormal situation that occurs on an aged man living alone or the like, using only an inexpensive table tap, without changing his conventional living environment.

DISCLOSURE OF THE INVENTION

In order to solve the above-mentioned problems, a table tap according to claim 1 of the invention is a table tap for detecting the use condition of an electric appliance which is plugged in a socket of the table tap, and this table tap comprises a time measurement means for measuring time; a power detection means for detecting the power consumption of the electric appliance plugged in the socket of the table tap; a judgement means for judging whether the power consumption detected by the power detection means matches a predetermined judgement condition or not, with reference to time information supplied from the time measurement means; and a communication means for communicating with the outside on the basis of the result of the judgement by the judgement means.

Therefore, occurrence of an abnormal situation on an aged man living along or the like can be detected and informed to the outside, using an inexpensive table tap alone, without modifying an electric appliance and a wall socket at home.

According to claim 2 of the invention, the table tap according to claim 1 further comprises a physical latch mechanism for preventing the plug of the electric appliance from being disconnected from the socket of the table tap.

Therefore, occurrence of an abnormal situation on an aged man living along or the like can be detected and informed to the outside, using an inexpensive table tap alone, without modifying an electric appliance and a wall socket at home. Moreover, it is possible to easily prevent malfunction of abnormality detection due to disconnection of the plug of the electric appliance.

A monitor system using a table tap according to claim 3 of the present invention comprises a table tap for detecting the use condition of an electric appliance which is plugged in a socket of the table tap; a base station for monitoring the user of the electric appliance on the basis of the use condition of the electric appliance which is detected by the table tap; and a communication means for notifying the base station of the result of the detection by the table tap, and the table tap comprises a time measurement means for measuring time; a power detection means for detecting the power consumption of the electric appliance plugged in the socket of the table tap; and a judgement means for judging whether the power consumption detected by the power detection means matches a predetermined judgement condition or not, with reference to time information supplied from the time measurement means.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored.

According to claim 4 of the invention, in the monitor system using a table tap according to claim 3, the communication means performs bi-directional communication between the table tap and the base station.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, information from the base station can be transmitted to the table tap side.

According to claim 5 of the invention, in the monitor system using a table tap according to claim 3, the table tap communicates with the base station when there is no variation in the power consumption detected by the power detection means for more than a predetermined period of time.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored.

According to claim 6 of the invention, in the monitor system using a table tap according to claim 3, the table tap communicates with the base station when there is no variation in the power consumption detected by the power detection means within a predetermined period of time.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored.

According to claim 7 of the invention, in the monitor system using a table tap according to claim 3, the table tap communicates with the base station when the power detection means cannot detect a predetermined amount of electric power within a predetermined period of time.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored.

According to claim 8 of the invention, in the monitor system using a table tap according to claim 3, the table tap communicates with the base station when the power detection means cannot detect a predetermined amount of electric power at a predetermined time.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored.

According to claim 9 of the invention, in the monitor system using a table tap according to claim 3, the table tap communicates with the base station when the power detection means continues to detect a predetermined amount of electric power even after a predetermined time has passed.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored.

According to claim 10 of the invention, in the monitor system using a table tap according to claim 3, the table tap communicates with the base station when the power detection means cannot detect a predetermined amount of electric power at a predetermined time on a predetermined day of the week.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored.

According to claim 11 of the invention, in the monitor system using a table tap according to claim 3, the table tap further comprises a judgement condition setting means for setting, according to the user of the electric appliance, at least two judgement conditions among the following six judgement conditions: a first judgement condition that the power consumption detected by the power detection means has no variation for more than a predetermined period of time; a second judgement condition that the power consumption detected by the power detection means has no variation within a predetermined period of time; a third judgement condition that the power detection means cannot detect a predetermined amount of electric power within a predetermined period of time; a fourth judgement condition that the power detection means cannot detect a predetermined amount of electric power at a predetermined time; a fifth judgement condition that the power detection means continues to detect a predetermined amount of electric power even after a predetermined time has passed; and a sixth judgement condition that the power detection means cannot detect a predetermined amount of electric power at a predetermined time on a predetermined day of the week. The table tap communicates with the base station when one of the two or more judgement conditions is satisfied.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored.

According to claim 12 of the invention, in the monitor system using a table tap according to claim 3, the table tap further comprises a judgement condition setting means for setting at least two judgement conditions among the following six judgement conditions: a first judgement condition that the power consumption detected by the power detection means has no variation for more than a predetermined period of time; a second judgement condition that the power consumption detected by the power detection means has no variation within a predetermined period of time; a third judgement condition that the power detection means cannot detect a predetermined amount of electric power within a predetermined period of time; a fourth judgement condition that the power detection means cannot detect a predetermined amount of electric power at a predetermined time; a fifth judgement condition that the power detection means continues to detect a predetermined amount of electric power even after a predetermined time has passed; and a sixth judgement condition that the power detection means cannot detect a predetermined amount of electric power at a predetermined time on a predetermined day of the week. Further, the table tap comprises a judgement condition switch means for selecting, from the set judgement conditions, a judgement condition on which the table tap communicates with the base station.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored.

According to claim 13 of the invention, the monitor system using a table tap according to any of claims 11 and 12 further comprises a parameter selection means for selecting a set time and a set value of electric power which are parameters required to set the first to sixth judgement conditions.

Therefore, occurrence of an abnormal situation on an aged man living along or the like can be detected and informed by using an inexpensive table tap alone, on the basis of the judgement conditions which are appropriately set by setting the parameters. Further, since a monitor device such as a camera is not used, an abnormal situation can be detected without making the user uncomfortable by being monitored.

According to claim 14 of the invention, the monitor system using a table tap according to any of claims 11 and 12 further comprises a parameter input means for inputting a set time and a set value of electric power which are parameters required to set the first to sixth judgement conditions.

Therefore, occurrence of an abnormal situation on an aged man living along or the like can be detected and informed by using an inexpensive table tap alone, on the basis of the judgement conditions which are appropriately set by inputting the parameters. Further, since a monitor device such as a camera is not used, an abnormal situation can be detected without making the user uncomfortable by being monitored.

According to claim 15 of the invention, in the monitor system using a table tap according to claim 4, any of the following six judgement conditions is set on the table tap from the base station: a first judgement condition that the power consumption detected by the power detection means has no variation for more than a predetermined period of time; a second judgement condition that the power consumption detected by the power detection means has no variation within a predetermined period of time; a third judgement condition that the power detection means cannot detect a predetermined amount of electric power within a predetermined period of time; a fourth judgement condition that the power detection means cannot detect a predetermined amount of electric power at a predetermined time; a fifth judgement condition that the power detection means continues to detect a predetermined amount of electric power even after a predetermined time has passed; and a sixth judgement condition that the power detection means cannot detect a predetermined amount of electric power at a predetermined time on a predetermined day of the week.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored.

According to claim 16 of the invention, in the monitor system using a table tap according to claim 15, the base station includes a judgement condition storage means for storing the judgement conditions set on the table tap.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored. Moreover, the judgement conditions can be stored at the base station side.

According to claim 17 of the invention, in the monitor system using a table tap according to claim 15, when one of the judgement conditions set on the table tap from the base station is satisfied, the table tap transmits an identification code specific to the table tap and the satisfied judgement condition, to the base station.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored. Moreover, the table tap which has detected the abnormal situation, and the detail of the judgement condition can be grasped at the base station side.

According to claim 18 of the invention, in the monitor system using a table tap according to claim 17, the base station possesses a table on which the identification code specific to the table tap transmitted from the table tap is associated with the judgement conditions set on the table tap.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored. Moreover, the identification code of the table tap, which has detected the abnormal situation, and the detail of the judgement condition can be grasped at the base station side.

According to claim 19 of the invention, in the monitor system using a table tap according to claim 18, the name of the user of the table tap and where to make contact with the user are used as the identification code specific to the table tap which is included in the table of the base station.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored. Moreover, the user of the table tap, which has detected the abnormal situation, and the detail of the judgement condition can be grasped at the base station side.

According to claim 20 of the invention, in the monitor system using a table tap according to claim 18, the production code of the table tap is used as the identification code specific to the table tap which is included in the table of the base station.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored. Moreover, the production code of the table tap, which has detected the abnormal situation, and the detail of the judgement condition can be grasped at the base station side.

According to claim 21 of the invention, in the monitor system using a table tap according to claim 20, the base station possesses a table on which the production code specific to the table tap is associated with the name of the user of the table tap and where to make contact with the user.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored. Moreover, the user of the table tap, which has detected the abnormal situation, and the detail of the judgement condition can be grasped at the base station side.

According to claim 22 of the invention, in the monitor system using a table tap according to claim 15, the base station displays, on a base station terminal, the contents of the judgement conditions set on the table tap.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored. Moreover, the user of the table tap, which has detected the abnormal situation, and the detail of the judgement condition can be easily confirmed at the base station side.

According to claim 23 of the invention, in the monitor system using a table tap according to claim 17, the base station searches the table for the name of the user of the table tap and where to make contact with the user, on the basis of the identification code of the table tap transmitted from the table tap, and displays these data on the base station terminal and, further, displays the contents of the satisfied judgement condition on the base station terminal, on the basis of the judgement condition transmitted from the table tap.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored. Moreover, the user of the table tap, which has detected the abnormal situation, and the detail of the judgement condition can be easily confirmed at the base station side.

According to claim 24 of the invention, in the monitor system using a table tap according to claim 15, the table tap further comprises a display unit for displaying the judgement conditions set from the base station.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored. Moreover, the judgement condition can be easily confirmed at the table tap side.

According to claim 25 of the invention, in the monitor system using a table tap according to claim 15, the table tap further comprises a facsimile for outputting the judgement conditions set by the base station, as a facsimile signal, through the communication line to the outside.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored. Moreover, the judgement condition can be easily confirmed with the facsimile in the vicinity of the table tap.

According to claim 26 of the invention, in the monitor system using a table tap according to claim 15, the table tap further comprises a speaker, and audio notification means for outputting the set judgement conditions as an audio signal to the speaker.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored. Moreover, the detected judgement condition can be grasped at the table tap side.

According to claim 27 of the invention, in the monitor system using a table tap according to claim 15, the base station automatically sets a set time and a set value of electric power which are parameters required to set the judgement condition, on the base tap, according to the season.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored.

According to claim 28 of the invention, in the monitor system using a table tap according to claim 15, the base station automatically sets a set time and a set value of electric power which are parameters required to set the judgement condition, on the base tap, according to the weather.

Therefore, occurrence of an abnormal situation on an aged man living along or the like can be detected and informed by using an inexpensive table tap alone, on the basis of the judgement conditions which are appropriately set from the base station. Further, since a monitor device such as a camera is not used, an abnormal situation can be detected without making the user uncomfortable by being monitored.

According to claim 29 of the invention, in the monitor system using a table tap according to claim 4, the table tap and the base station are provided with speakers and microphones, respectively, to enable conversation between the table tap and the base station.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, the base station can confirm, by audio, whether there occurs an abnormal situation on the user or not.

According to claim 30 of the invention, in the monitor system using a table tap according to claim 17, the table tap and the base station are provided with speakers and microphones, respectively, to enable conversation between the base station and the table tap; and when one of the judgement conditions set on the table tap from the base station is satisfied, the table tap transmits its identification code and the satisfied judgement condition as a modem signal to the base station and, thereafter, the table tap changes the modem signal to an audio signal to enable conversation with the base station using the speakers and the microphones.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, the base station can confirm, by audio, whether there occurs an abnormal situation on the user or not.

According to claim 31 of the invention, in the monitor system using a table tap according to claim 29, wherein the base station can control the volumes of the speaker and microphone of the table tap.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, the base station can confirm, by audio with appropriate volume, whether there occurs an abnormal situation on the user or not.

According to claim 32 of the invention, in the monitor system using a table tap according to claim 3, the table tap further comprises time-basis storage means for storing the power consumption detected by the power detection means, at every predetermined period of time; and comparison means for comparing the power consumption stored in the time-basis storage means with the power consumption which is actually detected; and the table tap communicates with the base station when the result of the comparison by the comparison means indicates a difference larger than a predetermined value.

Therefore, occurrence of an abnormal situation on an aged man living along or the like can be detected and informed by using an inexpensive table tap alone, without knowing the life pattern of the user in advance. Further, since a monitor device such as a camera is not used, an abnormal situation can be detected without making the user uncomfortable by being monitored.

According to claim 33 of the invention, in the monitor system using a table tap according to claim 32, the table tap further comprises a detection result updation means for updating the detected power consumption stored in the time-basis storage means.

Therefore, occurrence of an abnormal situation on an aged man living along or the like can be detected and informed by using an inexpensive table tap alone, without knowing the life pattern of the user in advance. Further, since a monitor device such as a camera is not used, an abnormal situation can be detected without making the user uncomfortable by being monitored.

According to claim 34 of the invention, in the monitor system using a table tap according to claim 32, the table tap further comprises a detection result updation means for obtaining a weighted average between the detected power consumption stored in the time-basis storage means and the actually detected power consumption, at every corresponding period of time; and the table tap stores the result of the weighted averaging in the time-basis storage means as updated power consumption at every predetermined period of time.

Therefore, occurrence of an abnormal situation on an aged man living along or the like can be detected and informed by using an inexpensive table tap alone, on the basis of the judgement condition, without knowing the life pattern of the user in advance. Further, since a monitor device such as a camera is not used, an abnormal situation can be detected without making the user uncomfortable by being monitored.

According to claim 35 of the invention, in the monitor system using a table tap according to claim 4, the table tap further comprises a time-basis storage means for storing the power consumption detected by the power detection means, at every predetermined period of time; and the table tap transmits the detected power consumption stored in the time-basis storage means, together with the present power consumption detected by the power detection means, as information about detected power consumption, to the base station, at every predetermined period of time.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, the use condition of the electric appliance, which will be referred to when setting judgement conditions, can be informed to the base station at predetermined time intervals.

According to claim 36 of the invention, in the monitor system using a table tap according to claim 4, the table tap further comprises a time-basis storage means for storing the power consumption detected by the power detection means, at every predetermined period of time; and when there is a request from the base station, the table tap transmits the detected power consumption stored in the time-basis storage means, together with the present power consumption detected by the power detection means, as information about detected power consumption, to the base station.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, the use condition of the electric appliance, which will be referred to when setting judgement conditions, can be informed in response to a request from the base station.

According to claim 37 of the invention, in the monitor system using a table tap according to claim 4, the table tap further comprises an ON/OFF time storage means for detecting the times at which the connected electric appliance is switched on and off, and storing the result of the detection as ON/OFF time information; and when there is a request from the base station, the table tap transmits the ON/OFF time information to the base station.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, the use condition of the electric appliance, which will be referred to when setting judgement conditions, can be informed in response to a request from the base station.

According to claim 38 of the invention, in the monitor system using a table tap according to any of claims 35 to 37, the base station stores the information about the detected power consumption and the ON/OFF time information, which are transmitted from the table tap.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, the use condition of the electric appliance, which will be referred to when setting judgement conditions, can be stored in the base station.

According to claim 39 of the invention, in the monitor system using a table tap according to claim 38, the base station changes the set time and the set value of electric power which are parameters of the judgement condition set on the table tap, on the basis of the information about detected power consumption and the ON/OFF time information.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, the parameters of the abnormality judgement conditions can be changed according to the use condition of the electric appliance.

According to claim 40 of the invention, in the monitor system using a table tap according to any of claims 35 to 37, the table tap, after transmitting the information about detected power consumption and the ON/OFF time information, deletes the transmitted information from the time-basis storage means and the ON/OFF storage means, respectively.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, after transmitting the use condition of the electric appliance which will be referred to when setting judgement conditions, the use condition is deleted to prevent overflow of the ON/OFF storage means.

According to claim 41 of the invention, in the monitor system using a table tap according to claim 4, the table tap comprises at least two sockets into which electric appliances are plugged; a time measurement means for measuring time; a power detection means for detecting the amounts of power consumption of the respective electric appliances plugged in the respective sockets of the table tap; and a judgement means for integrally judging the respective amounts of power consumption detected by the power detection means, and deciding whether the result of the detection matches a predetermined judgement condition or not, with reference to time information measured by the time measurement means.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored.

According to claim 42 of the invention, in the monitor system using a table tap according to claim 41, the table tap communicates with the base station when one of the amounts of power consumption detected by the power detection means matches the predetermined judgement condition.

Therefore, occurrence of an abnormal situation on an aged man living along or the like can be speedily detected and informed by using an inexpensive table tap alone. Further, since a monitor device such as a camera is not used, an abnormal situation can be detected without making the user uncomfortable by being monitored.

According to claim 43 of the invention, in the monitor system using a table tap according to claim 41, the table tap communicates with the base station when at least two of the amounts of power consumption detected by the power detection means match the predetermined judgement conditions.

Therefore, occurrence of an abnormal situation on an aged man living along or the like can be reliably detected and informed by using an inexpensive table tap alone. Further, since a monitor device such as a camera is not used, an abnormal situation can be detected without making the user uncomfortable by being monitored.

According to claim 44 of the invention, in the monitor system using a table tap according to any of claims 3 and 4, the table tap comprises: a built-in power supply; a power detection means for detecting a voltage supplied from a wall socket through a plug attached to the table tap; and a warning means, to which power is supplied from the power supply, for outputting a beep sound when the power detection means detects that the plug is disconnected from the wall socket.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, it is possible to warn the user that abnormality detection by the table tap becomes inexecutable.

According to claim 45 of the invention, in the monitor system using a table tap according to claim 44, when the plug is disconnected from the wall socket, the table tap detects this at the power detection means, and communicates with the base station.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, it is possible to inform the base station that abnormality detection by the table tap becomes inexecutable.

According to claim 46 of the invention, in the monitor system using a table tap according to claim 44, when the plug of the table tap is disconnected from the wall socket, the table tap detects this at the power detection means and, if the plug is not inserted in the wall socket by a predetermined time, the table tap communicates with the base station.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, it is possible to inform, at a set time, the base station that abnormality detection by the table tap becomes inexecutable.

According to claim 47 of the invention, in the monitor system using a table tap according to any of claims 3 and 4, the table tap further comprises a switch for inhibiting communication with the base station.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, since communication is stopped while the table tap is not used, occurrence of false warning is reduced.

According to claim 48 of the invention, in the monitor system with a table tap according to claim 47, the table tap notifies the base station that the switch for inhibiting communication is turned on or off.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, since communication is stopped while the table tap is not used, occurrence of false warning is reduced, and the disuse of the table tap is informed to the base station.

According to claim 49 of the invention, in the monitor system using a table tap according to claim 47, the table tap further comprises a storage means for storing the time when the switch for inhibiting communication is turned off; and a warming means for outputting a beep when the switch is not turned on even when a predetermined time has passed from the time stored in the storage means.

Therefore, occurrence of an abnormal situation on an aged man living along or the like can be detected and informed by using an inexpensive table tap alone. Further, since a monitor device such as a camera is not used, an abnormal situation can be detected without making the user uncomfortable by being monitored. Moreover, it is possible to warn the use that the period in which the table tap is not used has passed and therefore the switch should be turned on.

BEST MODE TO EXECUTE THE INVENTION

Embodiment 1

Figure 1:
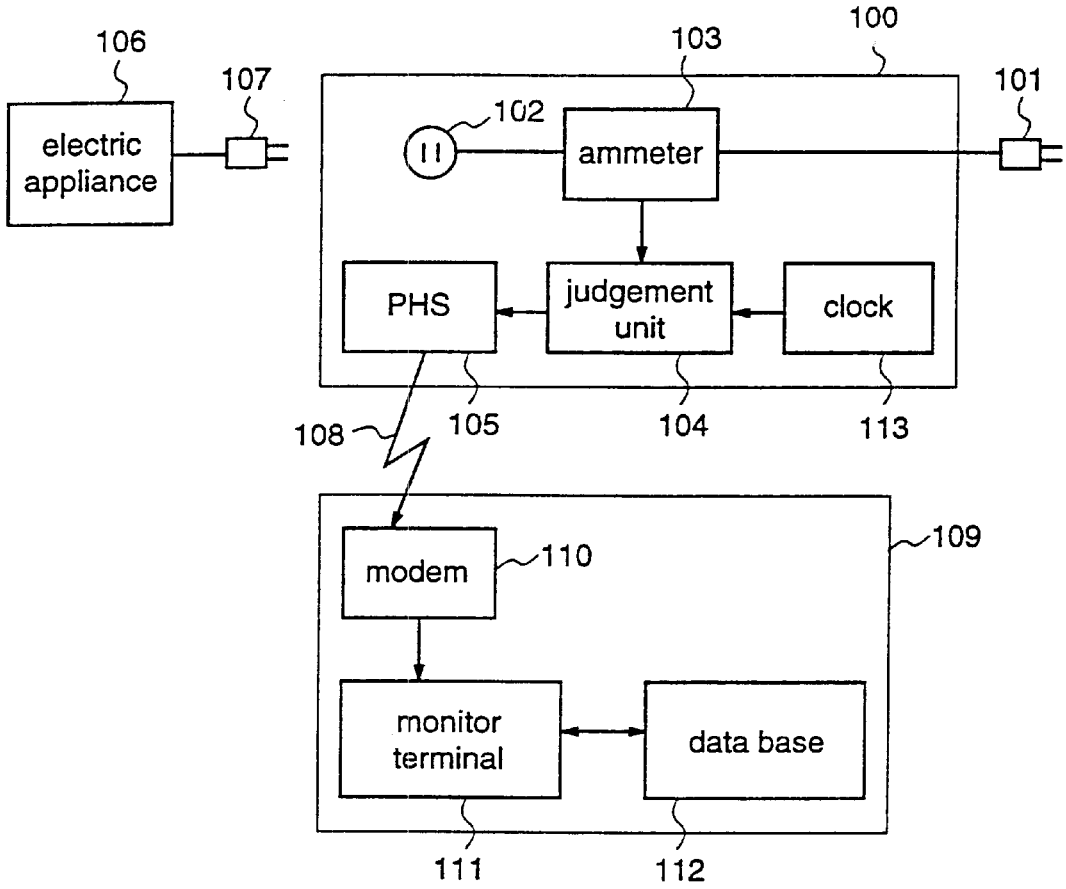
FIG. 1 is a block diagram illustrating a monitor system using a table tap according to a first embodiment of the present invention.

Hereinafter, a first embodiment of the present invention will be described with reference to FIG. 1. FIG. 1 is a block diagram illustrating a monitor system using a table tap according to the first embodiment of the invention. In this monitor system, a table tap 100 and a base station 109 are connected through a telephone line 108. The table tap 100 is connectable to an electrical appliance and detects the use condition of the connected electric appliance, and the base station 109 monitors the user of the electrical appliance on the basis of the use condition of the table tap 100. The table tap 100 has a plug 101 to be inserted in a wall socket which is not shown, and a socket 102. A plug 107 of an electrical appliance 106 is inserted in the socket 102. An ammeter 103 is connected between the plug 101 and the socket 102, and the power consumption of the electrical appliance 106 plugged in the socket 102 is measured by measuring the current which flows through the ammeter 103. A judgement unit 104 judges whether or not information about the power consumption detected by the ammeter 103 and information about the time supplied from a clock 113 match any of judgement conditions which have been set in advance. When there is a match, the judgement unit 104 decides that an abnormal situation occurs on the user of the electrical appliance connected to the table tap 100. The judgement conditions which have been set in advance will be described later. When the judgement unit 104 decides that an abnormal situation occurs; the table tap 100 transmits a unique number, which has been assigned to the table tap 100 in advance, to the base station 109, using a handy phone, such as a PHS 105, contained in the table tap 100. The unique number of the table tap 100 transmitted through the telephone line 108 is transmitted through a modem 110 of the base station 109 to a monitor terminal 111. On receipt of the unique number of the table tap 100, the monitor terminal 111 displays the occurrence of the abnormal situation. At this time, the monitor terminal 111 searches a data base 112 for the name, the residence, the type of the connected electrical appliance, etc. of the owner of the table tap, according to the unique number of the table tap 100, and displays these data. Since the table tap 100 uses a wall socket for home use as a power supply, the voltage is fixed at, for example, AC 100V. As the electric power can be equivalently obtained by measuring the current, in this system the electric power is detected by measuring the current at the ammeter 103.

Figure 2:
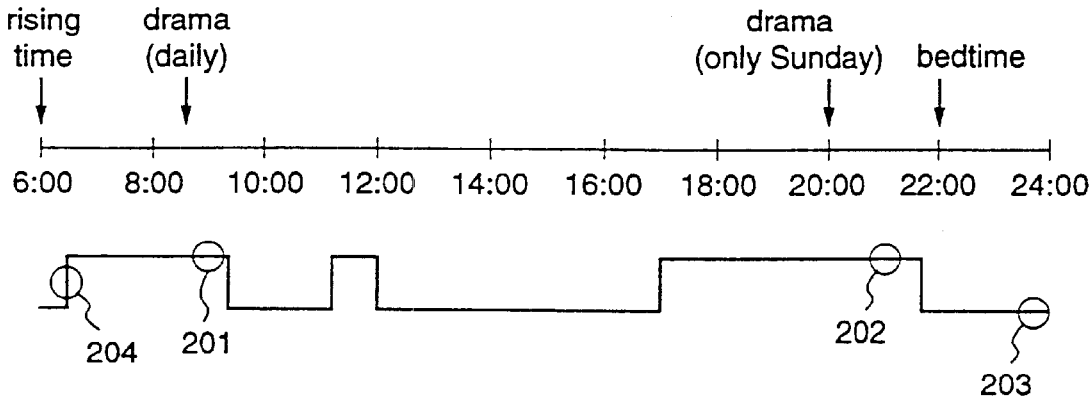
FIG. 2 is a diagram illustrating time periods when an aged man A uses a television.

Next, a description will be given of the conditions for judging an abnormal situation by the judgement unit 104, with reference to FIGS. 2 to 6. FIG. 2 shows the life pattern of an aged man A, which has been obtained in advance by questionnaire, and ON/OFF pattern of a TV estimated from the life pattern. More specifically, the upper section of FIG. 2 shows the life pattern of the aged man A with time, and TV programs he watches customarily. The lower section of FIG. 2 shows the TV ON/OFF pattern estimated from the life pattern. With reference to FIG. 2, every morning the aged man A gets up at about 6:00, and switches on the TV after a while. He never misses a drama that starts from 8:15 every day. Thereafter, he arbitrarily switches off and on the TV. He never misses a drama that starts from 20:00 on Sunday. As he goes to bed at about 22:00 every day, he switches off the TV before 22:00.

An abnormal situation that occurs on the aged man A is detected as follows. The TV is connected to the socket 102 of the table tap 100 so as to detect the ON/OFF of the TV from the pattern of power consumption. When any of judgement conditions described as follows is satisfied, the judgement unit 104 decides that an abnormal situation occurs.

Since the TV should be ON at time 201 every day, if the current value detected by the ammeter 103 at 8:20 is lower than 0.1 A, it is judged that an abnormal situation occurs. Since the TV should be ON at time 202 on Sunday, if the current value detected by the ammeter 103 at 20:10 on Sunday is lower than 0.1 A, it is judged that an abnormal situation occurs. Since the aged man A should switch the TV off and go to bed by time 203, if the current value detected by ammeter 103 at 24:00 is higher than 0.1 A, the judgement unit 104 decides that an abnormal situation occurs. Further, since he should be out of bed by time 204 and then turn on the TV, if the current value detected by the ammeter 103 from 5:30 to 7:00 has no change, it is judged that an abnormal situation occurs. Further, since the TV should not remain ON for more than 8 hours, if the current value detected by the ammeter 103 is higher than 0.1 A continuously for more than 8 hours, it is judged that an abnormal situation occurs. Since the TV should not remain OFF for more than twelve hours, if the current value detected by the ammeter 103 is lower than 0.1 A continuously for more than twelve hours, it is judged that an abnormal situation occurs. When any of the above-mentioned six conditions is satisfied, the judgement unit 104 decides that an abnormal situation occurs, and notifies the base station 109 of the abnormal situation by the PHS 105.

Figure 3:
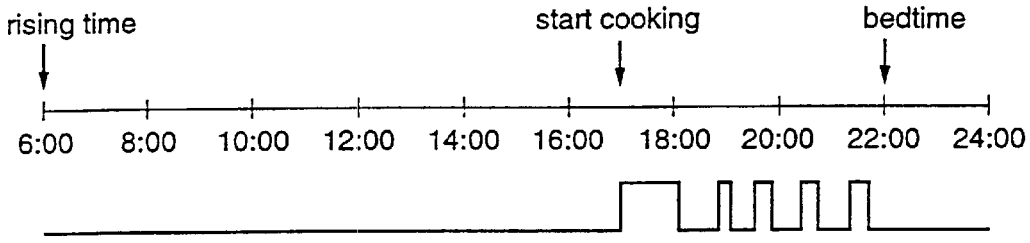
FIG. 3 is a diagram illustrating a time period when an aged man B uses an electric rice cooker.

FIG. 3 shows the life pattern of an aged man B, which has been obtained in advance by questionnaire, and the power consumption of an electric rice cooker estimated from the life pattern. To be specific, the upper section of FIG. 3 shows the life pattern of the aged man B with time, and the timing when he uses the rice cooker to prepare supper. The lower section of FIG. 3 shows the state of power consumption of the rice cooker, which is estimated from the life pattern. The rice cooker consumes large power during cooking from when it is switched on and, after the cooking is done, the rice cooker intermittently consumes the power for every several tens of seconds to keep the rice warm. Further, the aged man B certainly switches off the rice cooker before he goes to bed.

An abnormal situation of the aged man B is detected as follows. The rice cooker is connected to the socket 102 of the table tap 100 so as to detect the ON/OFF of the rice cooker from its power consumption pattern. When any of the following conditions is satisfied, the judgement unit 104 decides that an abnormal situation occurs.

First of all, since the aged man B cooks rice every day between 16:00 and 19:00, if there is no period where the current value detected by the ammeter 103 is continuously higher than 1 A for twenty minutes between 16:00 and 19:00, it is judged that an abnormal situation occurs. Further, since the rice cooker is switched off in the night, if the current value detected by the ammeter 103 exceeds 1 A during a period from 23:00 to 24:00, it is judged that an abnormal situation occurs.

Figure 4:
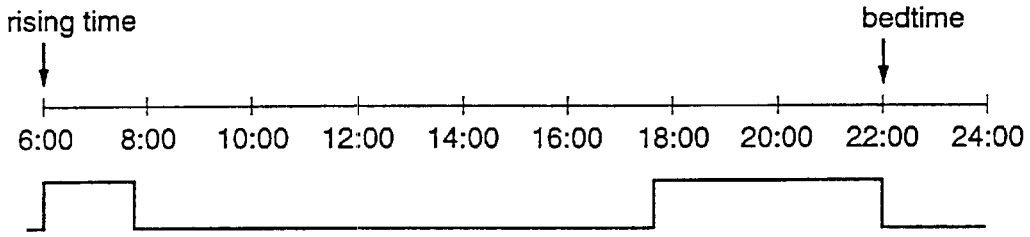
FIG. 4 is a diagram illustrating time periods when an aged man C uses an electric light.

FIG. 4 shows the life pattern of an aged man C, which has been obtained in advance by questionnaire, and the power consumption of an electric light estimated from the life pattern. It is assumed that the aged man C lives in a one-room house, and uses an electric light with a plug. The upper section of FIG. 4 shows the life pattern of the aged man C with time, and the lower section of FIG. 4 shows the state of power consumption of the electric light which is estimated from the life pattern. Usually, the aged man C gets up at 6:00, and then turns on the light if the room is poorly lighted. He turns off the light when the sun rises and thereby the room is well lighted. In the evening, he turns on the light after it gets dark, and turns off the light before he goes to bed.

An abnormal situation of the aged man C is detected as follows. The electric light is connected to the socket of the table tap 100 so as to detect the ON/OFF of the light from the power consumption pattern. When any of the following conditions is satisfied, the judgement unit 104 judges that an abnormal situation occurs.

Since the aged man C turns on the light between 6:00 and 7:00 every day, if there is no moment when the current value detected by the ammeter 103 exceeds 0.5 A in this period of time, it is judged that an abnormal situation occurs. Since the light should be OFF at 10:00 when the room is well lighted, if the current value detected by the ammeter 103 at 10:00 is higher than 0.5 A, it is judged that an abnormal situation occurs. Since he turns on the light between 16:00 and 18:00, if there is no edge at which the current value detected by the ammeter 103 changes from under 0.5 A to over 0.5 A in this period of time, it is judged that an abnormal situation occurs. Further, since he should be in bed by 24:00, if the current value detected by the ammeter 103 at 24:00 is higher than 0.5 A, it is judged that an abnormal situation occurs. Furthermore, from another point of view, it is also possible to decide that an abnormal situation occurs in the case where switch-off (switch-on) of the electric light is not performed within twelve hours from the latest switch-on (switch-off).

Figure 5:
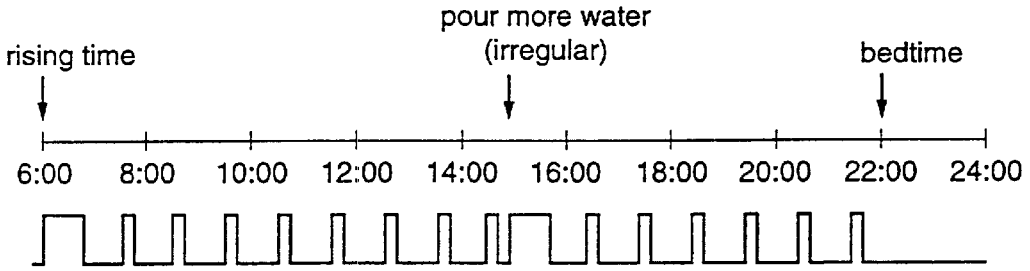
FIG. 5 is a diagram illustrating a time period when an aged man D uses an electric kettle.

FIG. 5 shows the life pattern of an aged man D, which has been checked in advance by questionnaire, and the power consumption of an electric kettle estimated from the life pattern. To be specific, the upper section of FIG. 5 shows the life pattern of the aged man D with time, and the timing when he pours more water in the electric kettle. The lower section of FIG. 5 shows the state of power consumption of the electric kettle estimated from the life pattern. Although, with reference to FIG. 5, the aged man D pours more water in the kettle at about 15:00, the time is actually not sure. However, considering the quantity of hot water he uses, it is sure that he pours more water in the electric kettle at least once a day. The electric kettle consumes large power from when it is switched on or water is poured in it to when the water is boiled. After the water is boiled, the electric kettle intermittently consumes electric power for every several tens of seconds to keep the water hot. Further, he surely switches off the electric kettle before he goes to bed.

An abnormal situation of the aged man D is detected as follows. The electric kettle is connected to the socket of the table tap 100 so as to detect the ON/OFF of the electric kettle from its power consumption pattern. When any of the conditions described below is satisfied with respect to the ON/OFF of the electric kettle, the judgement unit 104 judges that an abnormal situation occurs.

Since the aged man D switches on the electric kettle every morning, if there is no edge at which the current value detected by the ammeter 103 changes from under 1 A to over 1 A between 5:00 and 7:00, it is judged that an abnormal situation occurs. Since he surely pours more water in the kettle at least once during a period from 6:00 to 22:00 while he is up, if there is no period where the current value detected by the ammeter 103 is higher than 1 A continuously for more than ten minutes between 6:00 and 22:00, it is judged that an abnormal situation occurs. Further, since he switches off the electric kettle when he goes to bed, if the current value detected by the ammeter 103 exceeds 1 A between 23:00 and 24:00, it is judged that an abnormal situation occurs.

Figure 6:
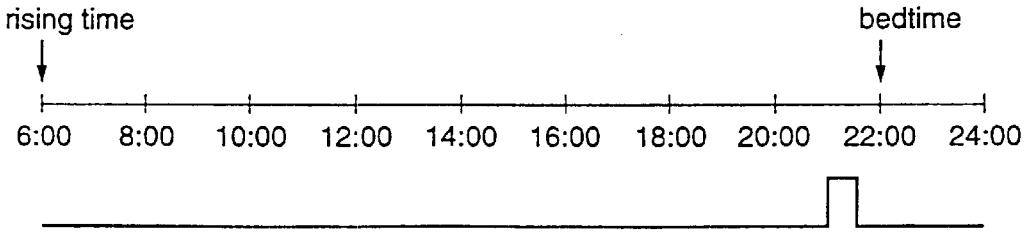
FIG. 6 is a diagram illustrating a time period when an aged man E uses a massage machine.

FIG. 6 shows the life pattern of an aged man E, which has been checked in advance by questionnaire, and the power consumption of a massage machine, which is estimated from the life pattern. To be specific, the upper section of FIG. 6 shows the life pattern of the aged man E with time, and the lower section of FIG. 6 shows the state of power consumption of the massage machine estimated from the life pattern. The aged man E uses the massage machine every day before he goes to bed, and he surely switches off the massage machine after the use.

An abnormal situation of the aged man E is detected as follows. The massage machine is connected to the socket 106 of the table tap 100 so as to detect the ON/OFF of the massage machine from its power consumption pattern. When any of the conditions mentioned below is satisfied with respect to the ON/OFF of the massage machine, the judgement unit 104 judges that an abnormal situation occurs.

First of all, since the aged man E switches on the massage machine every day before he goes to bed, if there is no period where the current value detected by the ammeter 103 is larger than 0.2 A continuously for more than ten minutes between 20:00 and 23:00, it is judged that an abnormal situation occurs. Since the aged man E switches off the massage machine after the use, if the current value detected by the ammeter 103 is higher than 0.2 A at 2:00, it is judged that an abnormal situation occurs.

Figure 9:
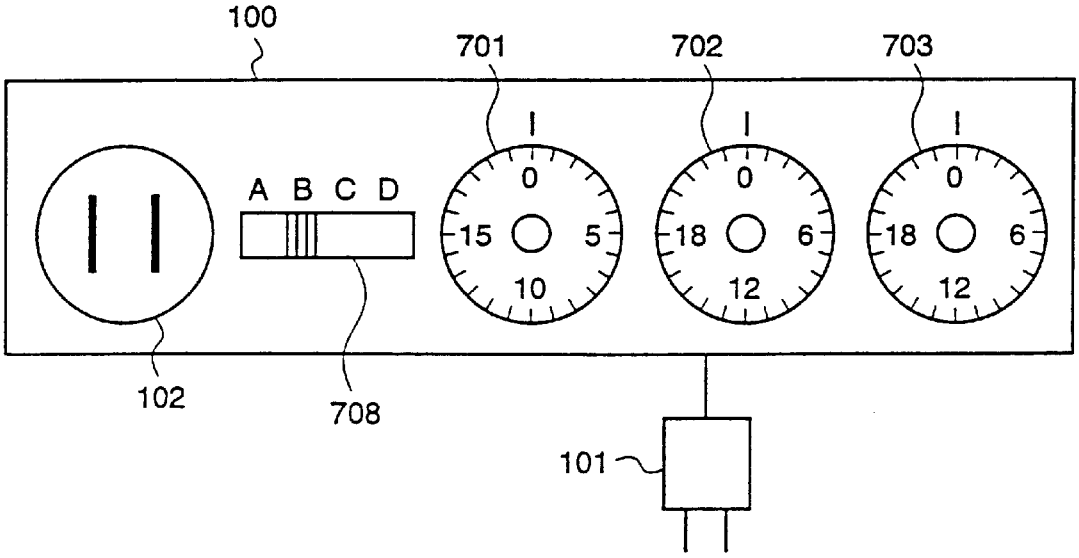
FIG. 9 is a diagram illustrating the appearance of the table tap according to the first embodiment.

As described above, after conducting questionnaire about the life pattern of each person, an electric appliance to be used for abnormality detection and the judgement conditions are determined and set in the judgement unit 104 of the table tap. Hereinafter, a method for setting the judgement conditions will be described with reference to FIG. 9. FIG. 9 is a diagram illustrating the appearance of the table tap 100. The table tap 100 is provided with a judgement condition switch 708, a value setting dial 701, a time setting dial A 702, and a time setting dial B 703. Although, in this first embodiment, the value setting dial and the time setting dial are used to set the value of electric power and the time, respectively, the same function will be achieved by inputting them using a numeric keypad or the like.

Figure 7:
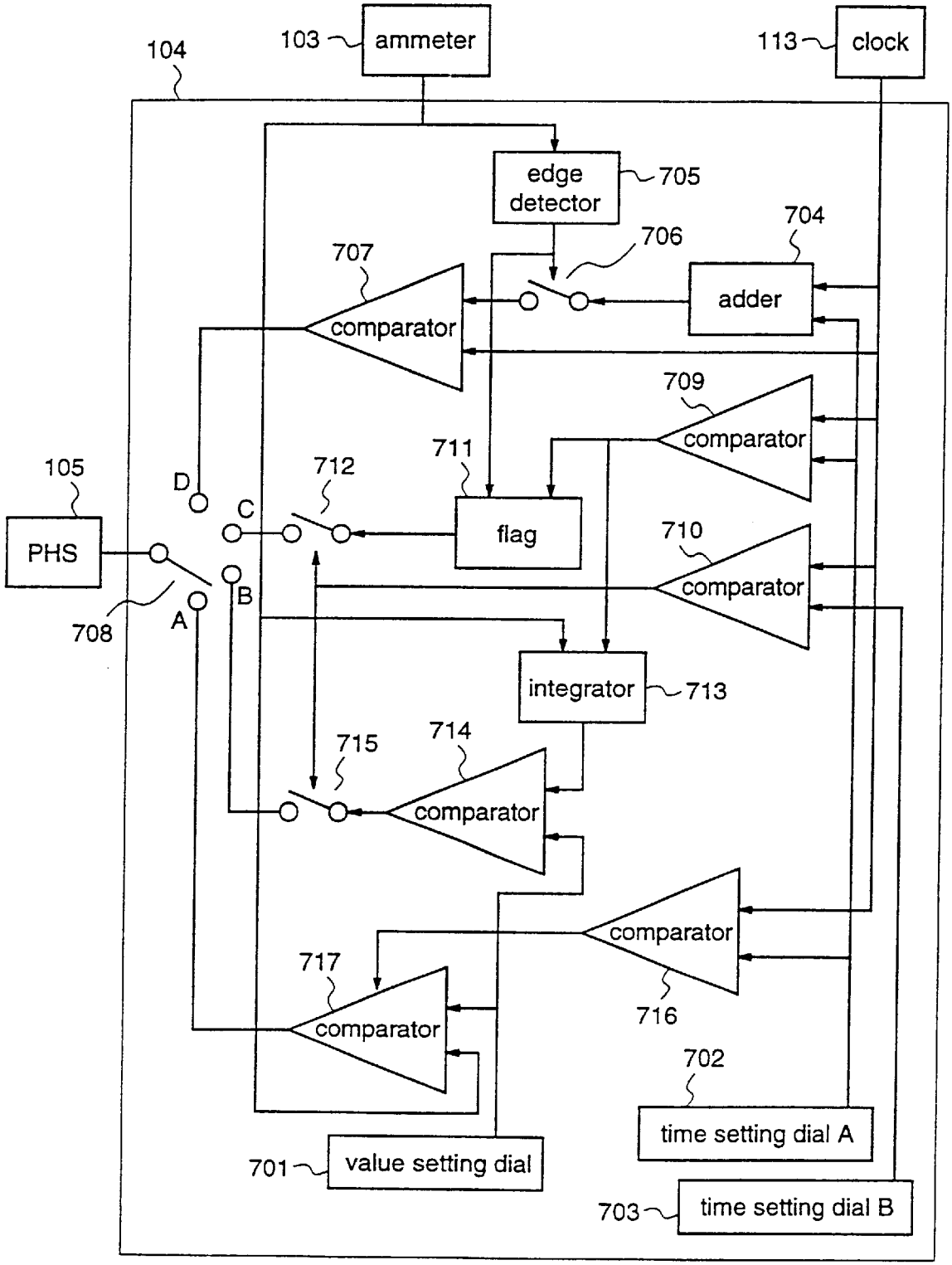
FIG. 7 is a block diagram illustrating a judgement unit contained in the table tap according to the first embodiment.

Next, the judgement unit 104 included in the table tap 100 will be described with reference to FIG. 7. FIG. 7 is a functional block diagram of the judgement unit 104, illustrating the constituents of the judgement unit 104 and the peripheral units relating to the operation of the judgement unit 104.

First of all, in the case of abnormality detection for the aged man A, if the current value is lower than 0.1 A at 8:20, it is judged that an abnormal situation occurs. Therefore, the judgement condition switch 708 is set at A, the value setting dial 701 is set at 0.1, and the time setting dial A 702 is set at 8:20. Under this setting, in a comparator 716, the present time supplied from a clock 113 is compared with 8:20 which is set on the time setting dial A702. When the present time matches the set time (8:20), a comparator 717 is enabled. The comparator 717 compares the present current value supplied from the ammeter 103 with the value (0.1) which is set on the value setting dial 701. When the present current value is lower than 0.1, the comparator 717 instructs the PHS 105 to notify the base station 109 of an abnormal situation.

In the case of abnormality detection for the aged man B, if there is no period where the current value detected by the ammeter 103 is higher than 1 A continuously for more than twenty minutes between 16:00 and 19:00, it is judged that an abnormal situation occurs. This judgement condition may be replaced with that decision of abnormal situation is made if the power consumption from 16:00 to 19:00 is lower than 10 Wh (as concerned here is only whether the aged man B used the rice cooker or not during this period of time, the value of electric power may be set roughly). Therefore, the judgement condition switch 708 is set at B, the value setting dial 701 is set at 10, the time setting dial A 702 is set at 16:00, and the time setting dial B 703 is set at 19:00. Under this setting, in a comparator 709, the present time supplied from the clock 113 is compared with 16:00 which is set on the time setting dial A702. While the present time is earlier than 16:00, the comparator 709 continues to clear an integrator 713. When the present time exceeds 16:00, this clearing is stopped, and the integrator 713 integrates the value supplied from the ammeter 103 and adds up the amount of power on and after 16:00. This amount of power is compared with the value (10) set on the value setting dial 701, by a comparator 714. On the other hand, the time (19:00) set on the time setting dial B703 is compared with the present time by a comparator 710. At the instant when the present time reaches the set time (19:00), a switch 715 is turned on. If, at this instant, the amount of power up to the present time is lower than 10 Wh according to a signal from the comparator 714, the comparator 714 instructs the PHS 105 to notify the base station 109 of an abnormal situation.

In the case of abnormality detection for the aged man C, if there is no edge at which the current value detected by the ammeter 103 changes from under 0.5 A to over 0.5 A between 16:00 and 18:00, it is judged that an abnormal situation occurs. Therefore, the judgement condition switch 708 is set at C, the time setting dial A 702 is set at 16:00, and the time setting dial B 703 is set at 18:00. Under this setting, in a comparator 709, the present time supplied from the clock 113 is compared with the time (16:00) set on the time setting dial A 702. While the present time is earlier than 16:00, the comparator 709 continues to clear a flag 711. When the present time exceeds 16:00, this clearing is stopped. On the other hand, an edge detector 705 monitors the ammeter 103, and sets the flag 711 the moment it detects that the electric light is switched on. On the other hand, the time (18:00) set on the time setting dial B 703 is compared with the present time by a comparator 710. At the instant when the present time reaches the set time (18:00), a switch 712 is turned on. If, at this instant, the flag 711 is in the cleared state, the comparator 710 instructs the PHS 105 to notify the base station 109 of an abnormal situation.

As another method of abnormality detection for the aged man C, it may be decided that an abnormal situation occurs if ON/OFF of the electric light is not conducted within twelve hours from the last ON/OFF. In this case, the judgement condition switch 708 is set at D, and the time setting dial A 702 is set at twelve hours. Under this setting, in an adder 704, the present time supplied from the clock 113 is added to twelve hours that is set on the time setting dial A702, and the adder 704 always outputs the time twelve hours after the present time. On the other hand, when there is switch-on or switch-off of the electric light, the edge detector 705 detects this, and the value of the adder 704 at this instance is transmitted to the comparator 707 through the switch 706. The comparator 707 holds this value, and compares it with the present time. When the next switching is performed within twenty hours, a new time is sent to the comparator 707 through the switch 706. When the next switching is not conducted after twelve hours have passed, since the comparator 707 decides that the time supplied from the adder 704 matches the present time, the comparator 707 instructs the PHS 105 to notify the base station 109 of an abnormal situation.

As described above, in the monitor system using the table tap according to the first embodiment, the table tap 100 which is connectable to an electric appliance and detects the use patter of the connected electric appliance, is connected through the telephone line 108 to the base station 109 which monitors the user of the electric appliance according to the use condition of the table tap 100. The table tap 100 decides whether the detected use condition of the electric appliance matches the judgement condition which has previously been set. When there is a match, the table tap 100 decides that an abnormal situation occurs, and notifies the base station 109 of this abnormal situation, through the telephone line 108. Therefore, abnormal situations of people having different life patterns can be respectively detected using one kind of equipment (table tap).

Embodiment 2

In the first embodiment of the invention, setting of conditions for judging abnormal situation (abnormality judgement conditions) is performed at the table tap side. In this case, however, if the user changes the setting by mistake, malfunction may occur. Further, in order to change the setting, it is necessary to send an operator to the house of the user of the table tap 100.

Figure 10:
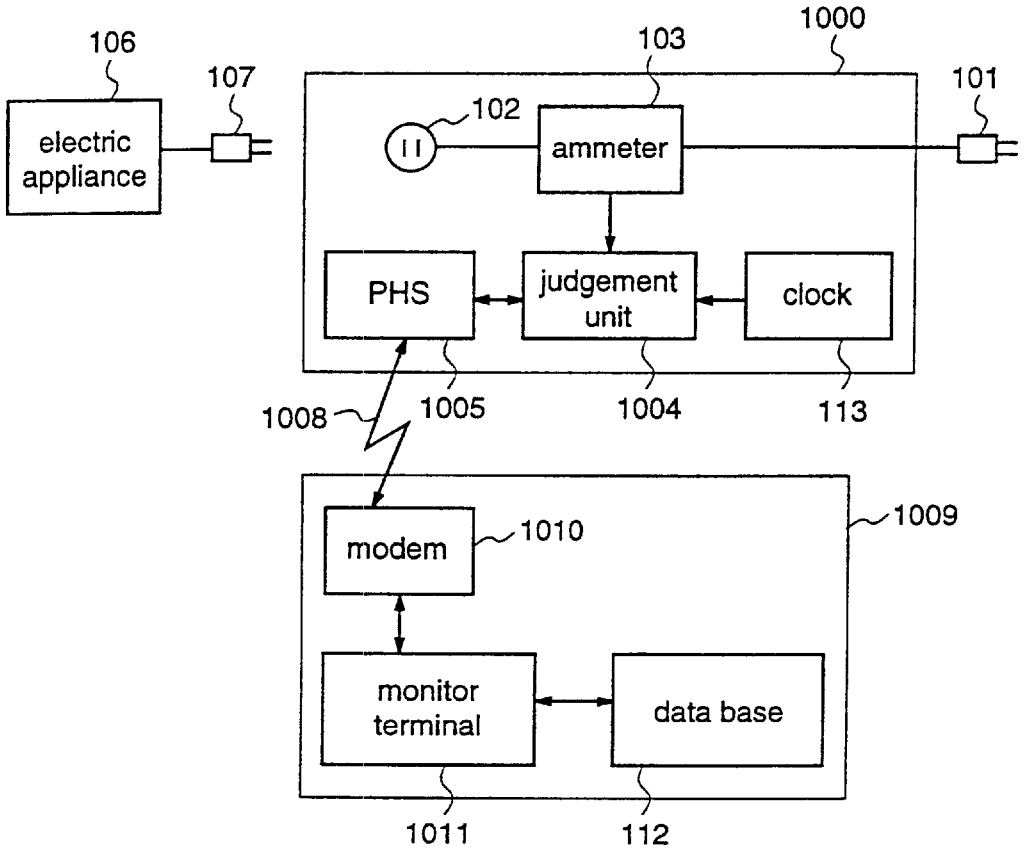
FIG. 10 is a block diagram illustrating a monitor system using a table tap according to a second embodiment of the present invention.

In order to save this inconvenience, a second embodiment of the invention permits the base station to set the abnormality judgement conditions in the table tap. Hereinafter, this second embodiment will be described with reference to FIG. 10. FIG. 10 is a block diagram illustrating a monitor system using a table tap according to the second embodiment. In the monitor system, a table tap 1000 is connected through a telephone line 1008 to a base station 1009. The table tap 1000 is connectable to an electric appliance, and detects the use condition of the connected electric appliance. The base station 1009 monitors the user of the electric appliance according to the use condition of the table tap 1000. The monitor system shown in FIG. 10 is different from the monitor system shown in FIG. 1 in that the flow of information from a judgement unit 1004 of the table tap 1000 through a handy phone such as a PHS 1005, a telephone line 1008, and a modem 1010 to a monitor terminal 1011 of the base station 1009 is bi-directional.

Figure 11:
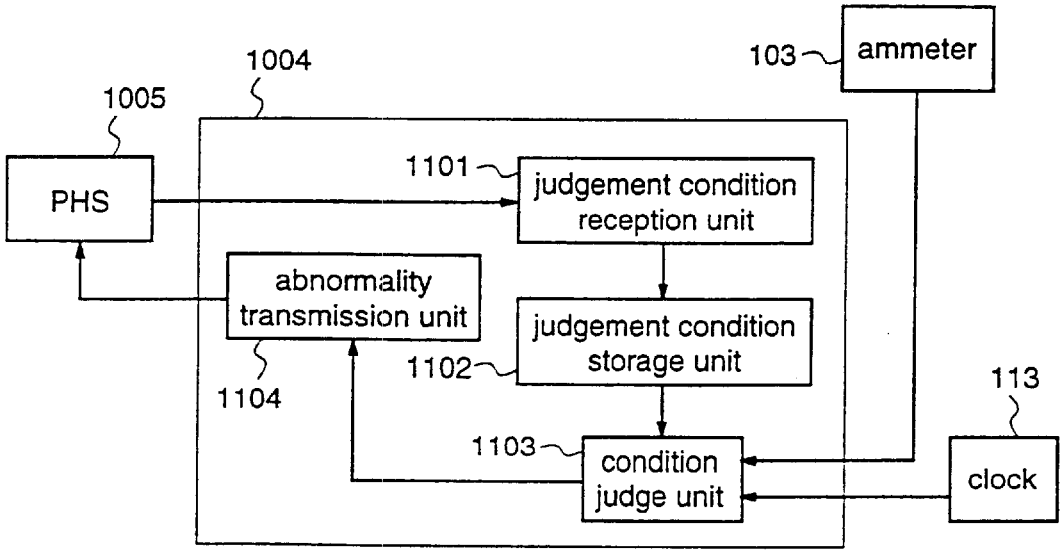
FIG. 11 is a block diagram illustrating a judgement unit contained in the table tap according to the second embodiment.

FIG. 11 shows a functional block of the judgement unit 1004 included in the table tap 1000. In FIG. 11, the abnormality judgement conditions, which are transmitted from the monitor terminal 1011 through the telephone line 1008, are relayed at the PHS 1005 and received by a judgement condition receiver 1101 to be stored in a judgement condition storage unit 1102. A condition judgement unit 1103 compares the states of the ammeter 103 and the clock 113 with the judgement conditions stored in the judgement condition storage unit 1102 to perform abnormality judgement. When the judgement unit 1103 decides that an abnormal situation occurs, it instructs an abnormality transmitter 1104 to notify the base station of the abnormal situation, and hands over the established judgement conditions to the transmitter 1104. The abnormality transmitter 1104 instructs the PHS 1005 to start communication with the base station 1009 and, simultaneously, transmits the ID code of the table tap 1000 and the established abnormality judgement conditions. In this second embodiment, the production code unique to the table tap is used as the ID code. However, the name of the owner of the table tap, which has been stored in advance, may be used. The data base 112 of the base station 1009 stores, in advance, a table on which the production codes of table taps are associated with the users, and a table on which the production codes of the table taps are associated with the contents of the judgement conditions. After the ID code and the judgement conditions have been transmitted, an audio communication line is established between the PHS 1005 and the monitor terminal 1011 to enable conversation from the monitor terminal 1011 using the mike and speaker of the PHS 1005.

Figures 12, 13:
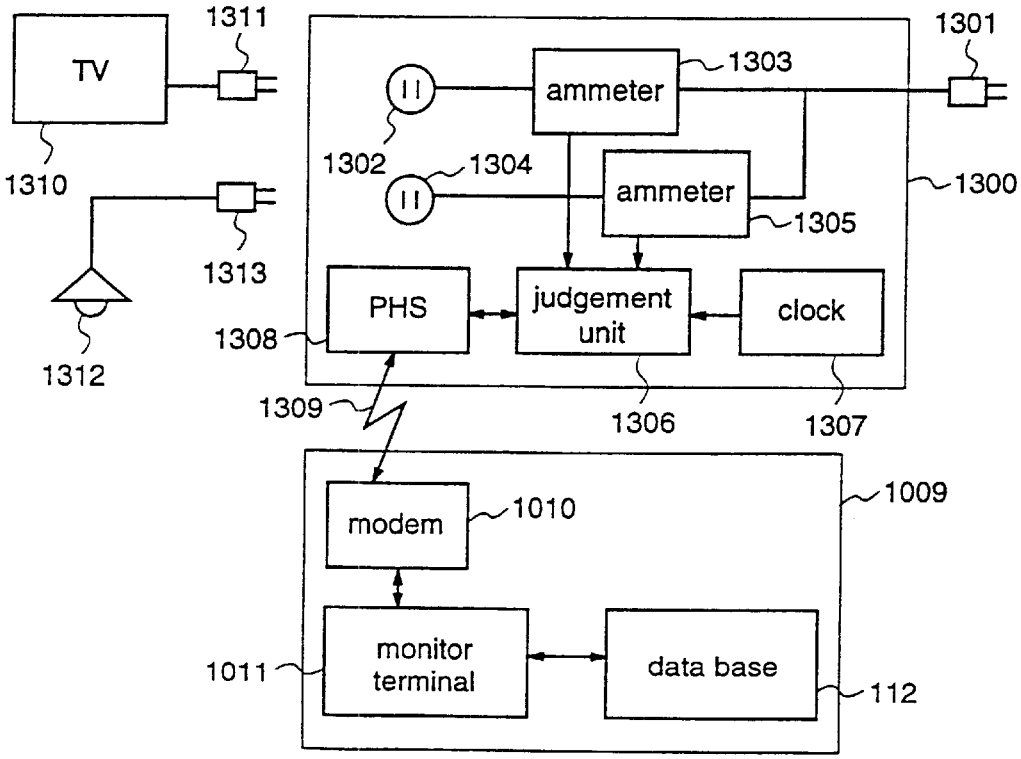
FIG. 12 is a diagram illustrating a data format of abnormal situation judgement conditions according to the second embodiment.
FIG. 13 is a block diagram illustrating a monitor system using a table tap according to a third embodiment of the present invention.

FIG. 12 shows examples of judgement conditions transmitted from the monitor terminal 1011. The judgement conditions are transmitted from the monitor terminal 1011 through the modem 1010 and the PHS 1005 to the judgement condition receiver 1101 and, simultaneously, they are stored in the data base 112 in association with the ID code of the table tap 1000. In FIG. 12, one frame (rectangle) indicates a signal of 1 byte. In each frame, a signal of 1 byte is displayed in hexadecimal.

FIG. 12 shows the judgement conditions for detecting an abnormal situation of the aged man A. First of all, "00H" at the beginning of header information 1201 means that the following data are abnormality judgement conditions. Accordingly, when the judgement condition receiver 1101 receives the "00H" as head data, it stores the data following this head data in the judgement condition storage unit 1102. The second value of the header information 1201 indicates the number of the judgement conditions. Since the second value is "04H", there are four judgement conditions.

Reference numeral 1202 denotes the first judgement condition, and "01H" at the beginning means that the aged man A is under abnormal situation when the current value is smaller than a value designated as follows at a time designated as follows in a day of the week designated as follows. The second value of the judgement condition 1202 designates days of the week, and the lower seven bits among the eight bits are assigned to the respective days of the week. When the corresponding bit is "1", abnormality judgement is performed on this day of the week. On the other hand, when the corresponding bit is "0", no abnormality judgement is performed on this day of the week. In FIG. 12, the second value is "7FH", and all of the seven bits are "1", meaning that abnormality judgement is performed on every day of the week. The third value of the judgement condition 1202 indicates the threshold of current, and it is described in units of 0.1 A. Since the third value is "01H", the threshold is 0.1 A. The fourth value of the judgement condition 1202 indicates "hour" of the designated time. In this case, "08H" means 8 o'clock. The fifth value of the judgement condition 1202 indicates "minute" of the designated time. Since "14H" is 20 in decimal, it means 20 minutes. In this way, the judgement condition 1202 means that the current value should be checked at 8:20 every day and, when the current value is lower than 0.1 A, it is decided that an abnormal situation occurs.

Reference numeral 1203 denotes the second judgement condition, and "01H" at the beginning means that the aged man A is under abnormal situation when the current value is smaller than a value designated as follows at a time designated as follows in a day of the week designated as follows. The second value of the judgement condition 1203 designates days of the week. Since the second value is "01H", only the bit indicating Sunday is "1", meaning that abnormality judgement is performed only on Sunday. Since the third value of the judgement condition 1203 is "01H", the threshold of current is 0.1 A. The fourth value of the judgement condition 1203 indicates "hour"of the designated time. As the fourth value "14H" is 20 in decimal, it means 20 o'clock. The fifth value of the judgement condition 1203 indicates "minute" of the designated time. As the fifth value "0AH" is 10 in decimal, it means 10 minutes. Therefore, the judgement condition 1203 means that the current value should be checked at 20:10 on Sunday and, when the current is lower than 0.1 A, it is decided that an abnormal situation occurs.

Reference numeral 1204 denotes the third judgement condition, and "02H" at the beginning means that the aged man A is under abnormal situation when the current value is larger than a value designated as follows on a time designated as follows in a day of the week designated as follows. The second value of the judgement condition 1204 indicates days of the week. Since the second value is "7FH" and all of the seven bits are "1", it means that abnormality judgement is performed on every day in the week. Since the third value of the judgement condition 1204 is "01H", the threshold value of the current is 0.1 A. The fourth value of the judgement condition 1204 indicates "hour" of the designated time, and the value "00H" means 0 o'clock. The fifth value of the judgement condition 1204 indicates "minute" of the designated time, and the value "00H" means 0 minute. Accordingly, the judgement condition 1204 means that the current value should be checked at 0:00 every day and, when the current is larger than 0.1 A, it is decided that an abnormal situation occurs.

Reference numeral 1205 denotes a fourth judgement condition, and "03H" at the beginning means that the aged man A is under abnormal situation when a change (edge) of current is not detected during a period designated as follows on a day of the week designated as follows. The second value of the judgement condition 1205 designates days in the week. Since this value is "7FH" and all of the seven bits are "1", it means that abnormality judgement should be performed on every day in the week. The third value of the judgement condition 1205 means the orientation of an edge. When this value is "01H", it means a rising edge, "02H" means a falling edge, and "03H" means either a rising edge or a falling edge. When there is no edge specified, it is decided that an abnormal situation occurs. Since the third value is "01H", a rising edge is to be detected. The fourth value of the judgement condition 1205 is "hour" of the start time of the designated period, and "5H" means 5 o'clock. The fifth value of the judgement condition 1205 is "minute" of the start time of the designated period, and "1EH" means 30 minutes. The sixth and seventh values of the judgement condition 1205 are "hour" and "minute" of the end time of the designated period, and "07H" and "00H" mean just 7 o'clock. Accordingly, the judgement condition 1205 means that when there is no rising edge of current (i.e., switch-on operation) during a period from 5:30 to 7:00 every day, it is judged that an abnormal situation occurs.

The above-mentioned four conditions are judged in parallel with each other. When at least one of these conditions is satisfied, it is decided that an abnormal situation occurs. At this time, the satisfied judgement condition is transmitted to the base station. The monitor terminal 1011 searches the data base 112, with reference to the ID code received, for the name and residence of the owner of the table tap 1000, and where to make contact with a helper to be sent or the like, who lives near the residence. Then, the monitor terminal 1011 displays these data as well as the established abnormality judgement condition. Since, at this stage, an audio communication line has already been established between the PHS 1005 of the table tap 1000 and the monitor terminal 1011, a monitoring staff can call out from the monitor terminal 1011 to ask the aged man A as to whether there occurs an abnormal situation or not. The volume of the speaker and mike of the PHS 1005 is desired to be controlled at the monitor terminal 1011 so that the monitoring staff can talk with the aged man A by increasing the volume even when the aged man A is far from the PHS 1005. If there is no answer to the monitoring staff's calling with increased volume, since there is the possibility that an abnormal situation occurs, the monitoring staff takes a step of, for example, making contact with the helper to be sent. However, when the monitoring staff can find out, from the conversation with the aged man A, that the program he has watched is just concluded and therefore the abnormality judgement condition should be changed, a new judgement condition is transmitted to the table tap 1000 in the same procedure as described above, thereby preventing further malfunction.

Although in this second embodiment four kinds of judgement conditions are described, the judgement conditions are not restricted thereto. Various kinds of conditions (e.g., no edge is detected within a predetermined period of time, or a predetermined amount of power is not consumed within a predetermined period of time) may be set and combined arbitrarily to perform abnormality detection according to various kinds of life patterns.

Next, a description will be given of the case where the abnormality judgement condition is whether an electric light which is connected to the table tap 1000 is on at a predetermined time in the evening, like the abnormality detection for the aged man C. When the time to perform abnormality judgement (judgement time) is set at 19:00, the electric light is surely on in winter, but in summer it is not sure whether the light is on at 19:00, and this may result in malfunction. On the other hand, when the judgement time is set at 20:00, although the light is surely on at 20:00 in both summer and winter, in winter the abnormality detection at 20:00 is one hour later than that at 19:00, and this may result in a delay in taking an action against an abnormal situation. Accordingly, when the abnormality judgement is performed according to whether the electric light is on at a predetermined time, a judgement time based on the sun set time is incorporated in the judgement condition every month, and the judgement condition is sent from the monitor terminal 1011 to the table tap 1000. Further, it is desired that the judgement time should be changed according to the weather. Accordingly, the monitor terminal 1011 is connected to an outdoor illuminance sensor and, when it gets darker than a predetermined value outside, a time one minute after the present time is incorporated as a judgment time in the judgement condition, and the judgement condition is sent from the monitor terminal 1011 to the table tap 1000.

At the base station, the judgement condition set on the table tap 1000 is displayed on the monitor terminal 1011 so that the monitoring staff can confirm the judgement conditions set on the table tap 1000, as necessary.

When mounting the table tap 1000, it may be required to confirm, at the table tap 1000, whether the judgement conditions are correctly set. In this case, the table tap 1000 is provided with a display unit (not shown). For example, the display unit comprises two columns of LED (Light-Emitting Diode) and one button, and the judgement conditions shown in FIG. 12 are displayed byte by byte every time the button is pressed.

Further, the set judgement conditions can be output as audio, using the speaker of the PHS 1005 included in the table tap 1000. Furthermore, when the table tap 1000 is placed in each private room of a home for the aged and a facsimile which can communicate with the PHS is placed in the vicinity of the table tap 1000, the judgement conditions may be transmitted from the PHS 1005 in the table tap 1000 to the facsimile.

As described above, in the monitor system using the table tap according to the second embodiment, bi-directional communication is realized between the table tap 1000 and the base station 1009 through the telephone line 1008. The base station 1009 sets the abnormality judgement conditions on the table tap 1000 through the telephone line 1008, and the table tap 1000 judges whether the detected use condition of the electric appliance matches any of the judgement conditions set by the base station 1009. When there is a match, the table tap 1000 decides that an abnormal situation occurs, and informs the abnormal situation to the base station 1009 through the telephone line 1008. Therefore, abnormal situations of people having different life patterns can be easily detected using one kind of equipment (table tap), on the basis of the judgement conditions set from the base station.

Embodiment 3

When performing abnormality detection on the aged man A according to the first and second embodiments, if an abnormal situation occurs after 8:20, this abnormal situation cannot be detected until 0:00 on weekdays. However, if the aged man A uses an electric light with a code having a plug, this electric light can be used together with the TV to perform abnormality detection speedily.

Hereinafter, a description will be given of a monitor system using a table tap according to a third embodiment, which is connected to two kinds of electric appliances. FIG. 13 is a block diagram illustrating a monitor system according to the third embodiment. In the monitor system, a table tap 1300 which is connectable to two kinds of electric appliances and detects the use conditions of the respective electric appliances, and a base station 1009 which monitors the user of the electric appliances according to the use conditions detected by the table tap 1300, are connected through a telephone line 1309 so that bi-directional communication is realized between the table tap 1300 and the base station 1009.

With reference to FIG. 13, the table tap 1300 has a plug 1301, and two sockets 1302 and 1304 which are connected in parallel with each other. For example, a plug 1311 of a TV set 1310 is connected to the socket 1302, and a plug 1313 of an electric light 1312 is connected to the socket 1304. An ammeter 1303 is connected between the plug 1301 and the socket 1302, and the power consumption of the electric appliance connected to the socket 1302 is measured by measuring the current at the ammeter 1303. Likewise, an ammeter 1305 is connected between the plug 1301 and the socket 1304, and the power consumption of the electric appliance connected to the socket 1304 is measured by measuring the current at the ammeter 1305. A judgement unit 1306 judges whether information about power consumption detected by the ammeter 1303 and 1305 and information about time supplied from a clock 1307 match any of judgement conditions which have already been set. When there is a match, the judgement unit 1306 decides that an abnormal situation occurs on the user of the electric appliance connected to the table tap 1300. When the judgement unit 1306 decides that an abnormal situation occurs, the table tap 1300 notifies the base station 1009 of this abnormal situation through a handy phone, such as a PHS 1308, contained in the table tap 1300.

Figure 14:
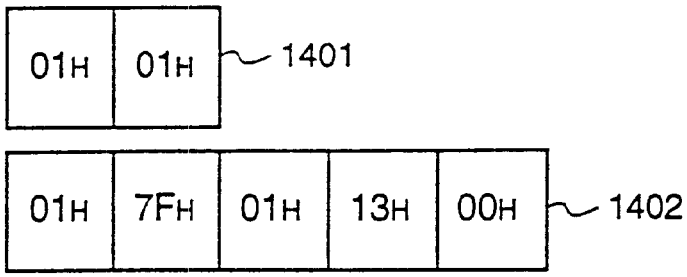
FIG. 14 is a block diagram illustrating a data format of abnormal situation judgement conditions according to the third embodiment.

As described for the second embodiment, the abnormality judgement conditions are transmitted from the monitor terminal 1011 of the base station 1009, through the modem 1010, the telephone line 1309, and the PHS 1308 to the judgement unit 1306 of the table tap 1300. As examples of the judgement conditions transmitted, there are 24 bytes of data shown in FIG. 12. In FIG. 12, "00H" at the beginning of the header 1201 means that the following information is a judgement condition for the ammeter 1303. Subsequently to this judgement condition, 7 bytes of data shown in FIG. 14 is transmitted. In FIG. 14, "01H" at the beginning of the header 1401 means that the following information is a judgement condition for the ammeter 1305. At the same time, the "01H" means that it is decided that an abnormal situation occurs, when either the judgement condition for the ammeter 1303 or the judgement condition for the ammeter 1305 is satisfied. The second value "01H" of the header 1401 means that there is one judgement condition for the ammeter 1305.

Reference numeral 1402 denotes a judgement condition, and "01H" at the beginning means that there occurs an abnormal situation when the current value is lower than a value designated as follows at a time designated as follows on a day of the week designated as follows. The second value of the judgement condition 1402 indicates days of the week. Since this value is "7FH" and all of the seven bits are "1", it means that abnormality judgement is performed every day in the week. The third value of the judgement condition 1402 is a threshold of current, and it is described in units of 0.1 A. Since the third value is "01H", the threshold is 0.1 A. The fourth value of the judgment condition 1402 indicates "hour" of the designated time, and the value "13H" means 19 o'clock. The fifth value of the judgment condition 1402 indicates "minute" of the designated time, and the value "00H" means 0 minutes. Accordingly, the judgement condition 1402 means that the current is checked at 19:00 every day and, when the current is lower than 0.1 A, it is decided that an abnormal situation occurs.

When at least one of this judgement condition and the judgement conditions shown in FIG. 12 is satisfied, it is decided that an abnormal situation occurs. Therefore, an abnormal situation can be detected speedily. When an abnormal situation occurs, the established judgement condition and information about the ammeter for which the judgement condition is established, are transmitted to the base station 1009, whereby the monitoring staff can check them on the monitor terminal 1011.

In this third embodiment, since prime importance is placed on speedup, occurrence of an abnormal situation is informed to the base station when one of the judgement conditions for the two ammeters is established. However, when prime importance is placed on avoiding incorrect information, occurrence of an abnormal situation should be informed to the base station when both of the judgment conditions for the two ammeters are established. In this case, in FIG. 14, the first value of the header 1401 is set at "02H" instead of "01H".

As described above, in the monitor system using the table tap according to the third embodiment, the table tap 1300 which is connectable to two kinds of electric appliances and detects the use conditions of the appliances connected, and the base station 1009 which monitors the user of the electric appliances according to the use conditions detected by the table tap 1300, are connected through the telephone line 1309 so that bidirectional communication can be made between the table tap 1300 and the base station 1009. The base station 1009 sets the abnormality judgement conditions on the table tap 1300 through the telephone line 1309, and the table tap 1300 decides whether the detected use condition of the electric appliance matches any of the judgement conditions set on it from the base station 1009. When there is a match, the table tap 1300 decides that an abnormal situation occurs, and notifies the base station 1009 of the abnormal situation. Therefore, it is possible to speedily detect abnormal situations of people having different life patterns, using one kind of equipment (table tap).

While in this third embodiment the table tap 1300 has two sockets, it may have three or more sockets. In this case, the table tap 1300 is provided with ammeters as many as the sockets.

Embodiment 4

Figure 8:
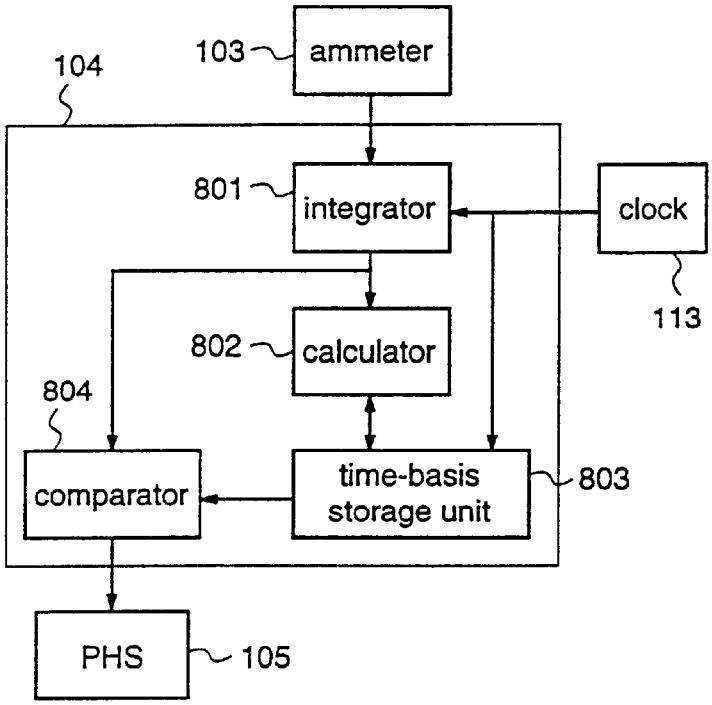
FIG. 8 is a block diagram illustrating a judgement unit contained in a table tap according to a fourth embodiment of the present invention.

In the aforementioned embodiments, it is necessary to know the user's life pattern in advance. In contrast with this, a fourth embodiment of the invention relates to a table tap for detecting an abnormal situation of the user when the user's life pattern is unknown. This table tap stores the power consumption every 30 minutes in a day and, when the power consumption in 30 minutes on a certain day is more than a predetermined value different from the stored power consumption in the corresponding period of time, the table tap decides that an abnormal situation occurs. FIG. 8 shows a judgement unit 104 to realize this fourth embodiment. In FIG. 8, the judgement unit 104 includes an integrator 801 which integrates the value detected by the ammeter 103 to obtain the power consumption. The integrator 801 sends the power consumption to an arithmetic unit 802 every 30 minutes indicated by the clock 113 and, thereafter, clears the power consumption to zero. In the arithmetic unit 802, the power consumption supplied from the integrator 801 and the power consumption in the corresponding period of time (30 minutes) which is supplied from a time-basis storage unit 803 are subjected to weighted addition at the ratio of 0.1:0.9. The value obtained by the arithmetic operation is sent back to the time-basis storage unit 803 to be stored as the power consumption in the corresponding period of time. On the other hand, a comparator 804 compares the stored power consumption outputted from the integrator 801 with the corresponding power consumption supplied from the time-basis storage unit 803, every 30 minutes indicated by the clock 113. When there is a difference higher than 50 Wh between them, the comparator 804 instructs the PHS 105 to notify the base station that an abnormal situation occurs. As the initial value of the time-basis storage unit 803, the power consumption obtained by the integrator 801 on the first day of the table tap's being used is stored as it is. In this case, for ten days from the first day, the amounts of power consumption stored in the time-basis storage unit 803 are not reliable and, therefore, notification of abnormality from the PHS 105 should be inhibited.

As described above, in the monitor system using the table tap according to the fourth embodiment, the table tap 100, which is connectable to an electric appliance and detects the use condition of the electric appliance, is connected with the base station 109, which monitors the user of the electric appliance according to the use condition of the table tap 100, through the telephone line 108. The table tap 100 stores the detected use condition of the electric appliance every predetermined period of time, and compares it with the actual use condition of the electric appliance. When the result of comparison shows a difference of more than a predetermined value, it is decided that an abnormal situation occurs, and the abnormal situation is informed to the base station 109 through the telephone line 108. Therefore, abnormal situations of people having different life patterns can be detected using one kind of device (table tap) even when the life patterns are not known in advance.

While in this fourth embodiment the time-basis storage unit 803 stores the power consumption every thirty minutes, the time interval may be arbitrarily changed.

Embodiment 5

Figure 15:
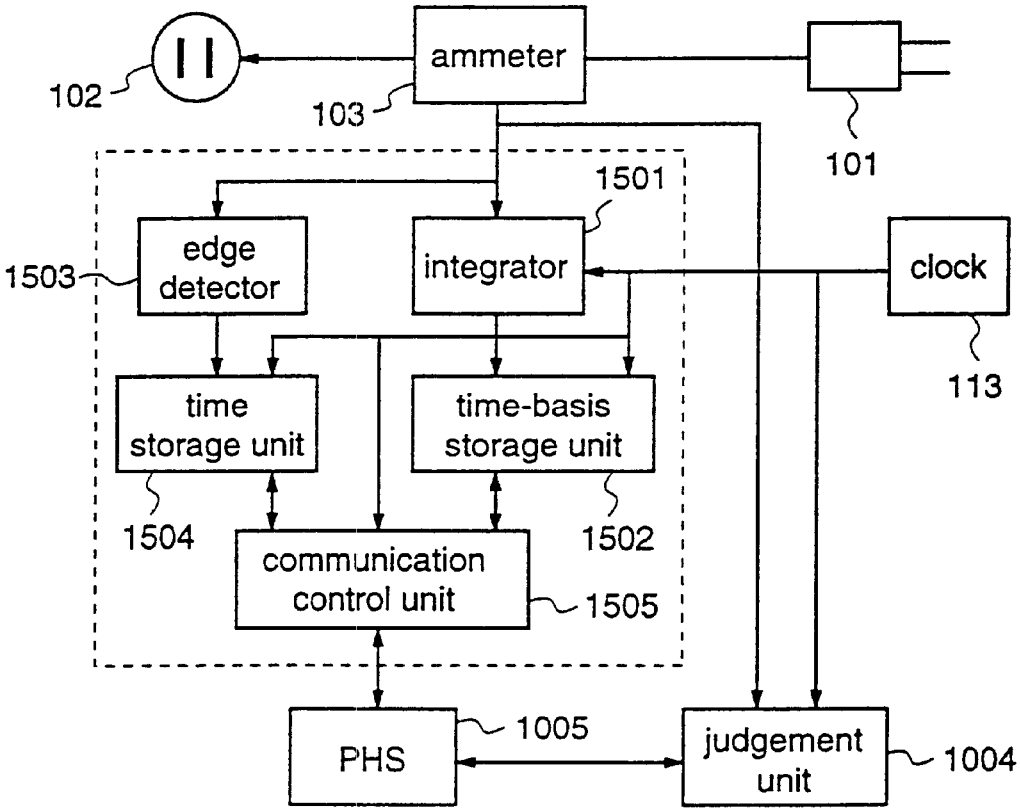
FIG. 15 is a block diagram illustrating a table tap according to a fifth embodiment of the present invention.

In the aforementioned embodiments, since the judgement conditions for abnormality detection are automatically set in the table tap, flexible setting of judgement conditions is not possible. For example, even in a time zone where the power consumption varies from day to day, if the power consumption deviates from the average by more than a predetermined value, the table tap judges that an abnormal situation occurs, resulting in high possibility of false warning. Further, even when the survey about life pattern is conducted by questionnaires as described for the first embodiment, there will be old people who do not precisely remember their life patterns, also resulting in false warning. In order to solve these problems, according to this fifth embodiment, the time-basis power consumption (the power consumption per predetermined period) or the switch ON/OFF timing is grasped every day at the base station end, and the most reliable judgement condition is decided statistically by a specialist, and this judgement condition is sent from the base station to the table tap through a communication means, thereby realizing highly reliable abnormality detection. An example of a table tap to realize this fifth embodiment will be described with reference to FIG. 15. FIG. 15 is a block diagram illustrating a table tap according to the fifth embodiment. This table tap is obtained by adding, to the table tap 1000 shown in FIG. 10, an integrator 1501, a time-basis storage unit 1502, an edge detector 1503, a time storage unit 1504, and a communication controller 1505, and these components are surrounded by dotted lines in FIG. 15.

In FIG. 15, the current flowing through the table tap 1000 is measured by the ammeter 103, and the current is integrated by the integrator 1501 to obtain the power consumption, and the power consumption is stored in the time-basis storage unit 1502 every 30 minutes. Simultaneously, switch-on and switch-off of the connected electric appliance is detected by the edge detector 1503, and the times at these moments (ON and OFF times) are separately stored in the time storage unit 1504. These data so stored are transmitted through the PHS 1005 to the base station 1009, under control of the communication control unit 1505. Thereafter, the data stored in the time-basis storage unit 1502 and the time storage unit 1504 are deleted. The timing to send the stored data is as follows: (1) at every predetermined period of time, (2) at the time when the storage unit is filled up, and (3) at the time when receiving a transmission request from the base station through the PHS 1005. An appropriate method should be selected according to the storage capacity and the facility of the system construction. Further, the time-basis storage unit 1502 can be dispensed with when the contents of the integrator 1501 are transmitted through the PHS 1005 directly to the base station at intervals of 30 minutes.

The table tap 1000 can transmit the power consumption detected by the ammeter 103 as well as the power consumption stored every 30 minutes, to the base station 1009.

The data so transmitted to the base station are retained in the data base 112 for several days, and a specialist determines the most reliable judgement condition on the basis of the data, and this judgement condition is sent from the base station to the table tap through the communication line, in the same procedure as described for the third embodiment.

As described above, in the monitor system using the table tap according to the fifth embodiment of the invention, the time-basis power consumption of the electric appliance connected to the table tap 1000 or the ON/OFF times of the electric appliance are grasped every day at the base station 1009, and a specialist statistically analyzes this to determine the most reliable judgement condition, and this judgement condition is set on the table tap 1000 from the base station 1009 through the telephone line 1008. Further, the table tap 1000 judges whether the set judgement condition matches the detected use condition of the electric appliance. When there is a match, the table tap 1000 decides that there is an abnormal situation, and notifies the base station 1009 of the abnormal situation through the telephone line 1008. Therefore, abnormal situations of people having different life patterns can be reliably detected by using only one kind of device (table tap).

Embodiment 6

The monitor system using the table tap according to any of the first to fifth embodiments is premised on that the table tap is normally connected to a predetermined electric appliance. Therefore, if the user uses the table tap of the invention for another electric appliance or disconnects the plug, malfunction may occur. This sixth embodiment of the invention is made to prevent such malfunction.

Figure 16:
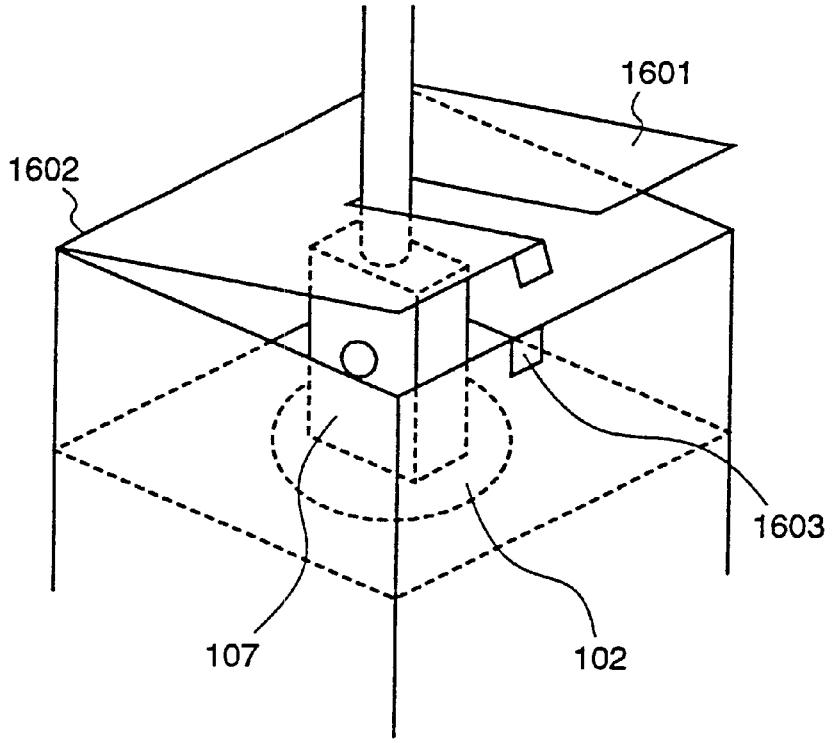
FIG. 16 is a diagram illustrating the appearance of a table tap in the vicinity of its socket, according to a sixth embodiment of the present invention.

First of all, the socket 102 of the table tap is provided with a latch mechanism so that the plug 107 of the electric appliance 106 is not disconnected from the socket 102. An example of the latch mechanism is shown in FIG. 16. In FIG. 16, the plug 107, which is inserted in the socket 102 of the table tap, is covered with a lid 1601. The lid 1601 is rotatable about a hinge 1602, and the lid 1601 is closed after inserting the plug 107 in the socket 102. Thereafter, the lid 1601 can be locked by the latch 1603. Thereby, the possibility that the plug 107 of the electric appliance 106 is disconnected from the socket 102 of the table tap by the user, is considerably lowered.

Figure 17:
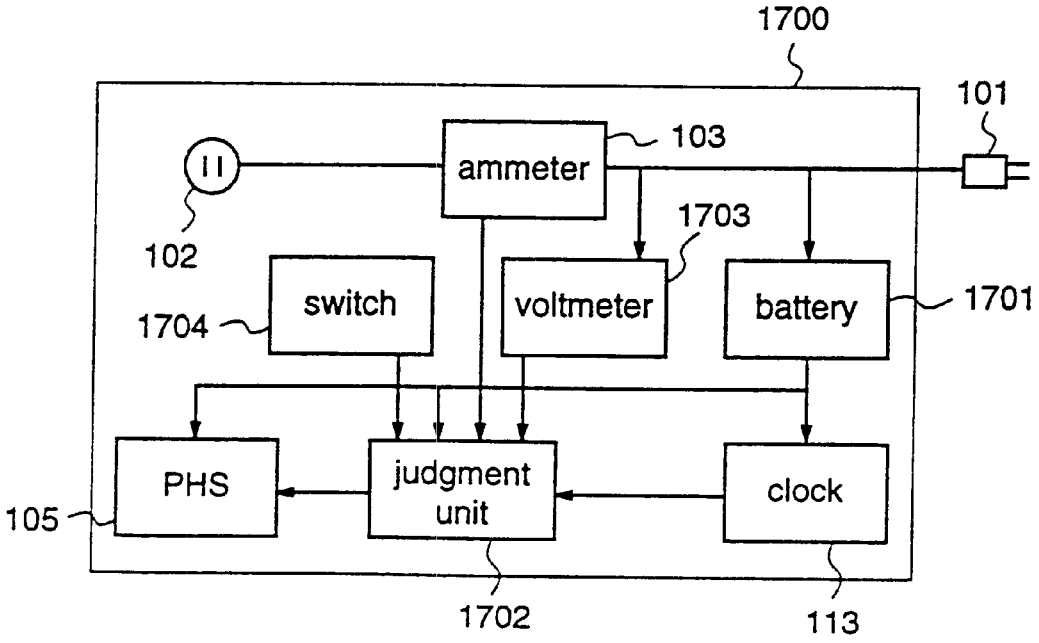
FIG. 17 is a block diagram illustrating a monitor system using the table tap according to the sixth embodiment.

Next, a description will be given of the countermeasure against the trouble that the plug 101 of the table tap is disconnected from the wall socket. Since the wall socket usually has no latch mechanism, the countermeasure against the case where the plug 101 is disconnected will be described with reference to FIG. 17. FIG. 17 is a block diagram illustrating the internal structure of a table tap 1700. This table tap 1700 is obtained by adding, to the table tap shown in FIG. 1, a battery 1701, a voltmeter 1703, and a switch 1704. In FIG. 17, even when the plug 101 is disconnected, the battery 1701, which stores electricity, supplies power to the clock 113, the judgement unit 1702, and the PHS 105. The disconnection of the plug is detected by the voltmeter 1703 and informed to the judgement unit 1702. The judgement unit 1702 outputs a beep from the speaker of the PHS 105 to notify the user that the plug 101 should not be disconnected. Alternatively, the judgment unit 1702, which detects that the plug 101 is disconnected, notifies the base station of this situation through the PHS 105, and a monitoring staff at the base station, who knows this, warns the user that the plug 101 should not be disconnected. However, only when the abnormality judgement condition is set such that notification of abnormality should be performed when switch-on is not performed at a predetermined time, the user is allowed to disconnect the plug 101. In this case, if the plug 101 is not inserted in the wall socket by the time set as the judgement condition, it is informed as an abnormal situation to the base station.

If the user of the table tap goes out, leaving the table tap as it is, there is the possibility that the judgement unit 1702 decides that an abnormal situation occurs and makes false warning. In order to avoid this problem, when the user of the table tap goes out, the user turns off the switch 1704 shown in FIG. 17. When the judgment unit 1702 detects an abnormal situation, it checks the switch 1704. When the switch 1704 is in the off state, the judgement unit 1702 does not inform the abnormal situation to the base station. However, when the switch 1704 is turned off or on, the judgement unit 1702 informs this to the base station through the PHS 105. Furthermore, when the switch 1704 is turned off, the judgement unit 1702 stores this time. If the switch 1704 is not turned on after a predetermined period of time (e.g., 24 hours) has passed, the judgement unit 1702 instructs the PHS 105 to output a beep from the speaker until the switch 1704 is turned on. The beep reminds the user, if he is near the table tap, to turn on the switch. Even if the user is not at home, he will hear the beep when he has come home, and turn on the switch 1704.

As described above, in the monitor system using the table tap according to the sixth embodiment, the table tap is provided with the latch mechanism that prevents the plug of the electric appliance from being disconnected from the socket of the table tap. Therefore, it is possible to avoid malfunction caused by that the user uses the table tap for another electric appliance or disconnects the plug.

Further, when the table tap detects that the plug of the electric appliance is disconnected from the socket, the table tap outputs a beep or informs this to the base station. Therefore, it is possible to warn the user or inform the base station that detection of abnormality by the table tap becomes non-executable.

Furthermore, since the table tap is provided with the switch for inhibiting the table tap from making communication with the base station, it is possible to stop notification of abnormality to the base station while the table tap is not used, thereby suppressing false warning.

While in the aforementioned embodiments the table tap contains the PHS as a communication means, the communication means of the table tap is not restricted to the PHS.

Further, while in the aforementioned embodiments the communication means of the table tap (i.e., the PHS) is contained in the table tap, it may be provided outside the table tap as long as it cannot be disconnected from the table tap.

Applicability in Industry

As described above, a table tap and a monitor system using the table tap according to the present invention relates to a warning device for informing an abnormal situation by using a communication line, and it is suitable for monitoring the daily life of the elderly living alone or the handicapped.

What is claimed is:

1. A table tap for detecting the use condition of an electric appliance which is plugged in a socket of the table tap, comprising:

a time measurement means for measuring time;

a power detection means for detecting the power consumption of the electric appliance plugged in the socket of the table tap;

a judgement means for judging whether the power consumption detected by the power detection means matches a predetermined judgement condition or not, with reference to time information supplied from the time measurement means; and a communication means for communicating with the outside on the basis of the result of the judgement by the judgement means.

2. A table tap as defined in claim 1 further comprising a physical latch mechanism which prevents the plug of the electric appliance from being disconnected from the socket of the table tap.

3. A monitor system using a table tap, comprising:

a table tap for detecting the use condition of an electric appliance which is plugged in a socket of the table tap;

a base station for monitoring the user of the electric appliance on the basis of the use condition of the electric appliance which is detected by the table tap;

a communication means for notifying the base station of the result of the detection by the table tap; and said table tap comprising:

a time measurement means for measuring time;

a power detection means for detecting the power consumption of the electric appliance plugged in the socket of the table tap; and a judgement means for judging whether the power consumption detected by the power detection means matches a predetermined judgement condition or not, with reference to time information supplied from the time measurement means.

4. A monitor system using a table tap as defined in claim 3, wherein said communication means performs bi-directional communication between the table tap and the base station.

5. A monitor system using a table tap as defined in claim 4 wherein any of the following six judgement conditions is set on the table tap from the base station:

a first judgement condition that the power consumption detected by the power detection means has no variation for more than a predetermined period of time;

a second judgement condition that the power consumption detected by the power detection means has no variation within a predetermined period of time;

a third judgement condition that the power detection means cannot detect a predetermined amount of electric power within a predetermined period of time;

a fourth judgement condition that the power detection means cannot detect a predetermined amount of electric power at a predetermined time;

a fifth judgement condition that the power detection means continues to detect a predetermined amount of electric power even after a predetermined time has passed; and a sixth judgement condition that the power detection means cannot detect a predetermined amount of electric power at a predetermined time on a predetermined day of the week.

6. A monitor system using a table tap as defined in claim 5, wherein said base station includes a judgement condition storage means for storing the judgement conditions set on the table tap.

7. A monitor system using a table tap as defined in claim 5 wherein, when one of the judgement conditions set on the table tap from the base station is satisfied, the table tap transmits an identification code specific to the table tap and the satisfied judgement condition, to the base station.

8. A monitor system using a table tap as defined in claim 7, wherein said base station possesses a table on which the identification code specific to the table tap transmitted from the table tap is associated with the judgement conditions set on the table tap.

9. A monitor system using a table tap as defined in claim 8, wherein the name of the user of the table tap and where to make contact with the user are used as the identification code specific to the table tap, which is included in the table of the base station.

10. A monitor system using a table tap as defined in claim 8, wherein the production code of the table tap is used as the identification code specific to the table tap, which is included in the table of the base station.

11. A monitor system using a table tap as defined in claim 10, wherein said base station possesses a table on which the production code specific to the table tap is associated with the name of the user of the table tap and where to make contact with the user.

12. A monitor system using a table tap as defined in claim 7, wherein said base station searches the table for the name of the user of the table tap and where to make contact with the user, on the basis of the identification code of the table tap transmitted from the table tap, and displays these data on the base station terminal and, further, displays the contents of the satisfied judgement condition on the base station terminal, on the basis of the judgement condition transmitted from the table tap.

13. A monitor system using a table tap as defined in claim 7 wherein:

said table tap and said base station are provided with speakers and microphones, respectively, to enable conversation between the base station and the table tap; and when one of the judgement conditions set on the table tap from the base station is satisfied, said table tap transmits its identification code and the satisfied judgement condition as a modem signal to the base station and, thereafter, the table tap changes the modem signal to an audio signal to enable conversation with the base station using the speakers and the microphones.

14. A monitor system using a table tap as defined in claim 5, wherein said base station displays, on a base station terminal, the contents of the judgement conditions set on the table tap.

15. A monitor system using a table tap as defined in claim 5, wherein said table tap further comprises a display unit for displaying the judgement conditions set from the base station.

16. A monitor system using a table tap as defined in claim 5, wherein said table tap further comprises a facsimile for outputting the judgement conditions set by the base station, as a facsimile signal, through the communication line to the outside.

17. A monitor system using a table tap as defined in claim 5, wherein said table tap further comprises:

a speaker; and audio notification means for outputting the set judgement conditions as an audio signal to the speaker.

18. A monitor system using a table tap as defined in claim 5, wherein said base station automatically sets a set time and a set value of electric power which are parameters required to set the judgement condition, on the base tap, according to the season.

19. A monitor system using a table tap as defined in claim 5, wherein said base station automatically sets a set time and a set value of electric power which are parameters required to set the judgement condition, on the base tap, according to the weather.

20. A monitor system using a table tap as defined in claim 4, wherein said table tap and said base station are provided with speakers and microphones, respectively, to enable conversation between the table tap and the base station.

21. A monitor system using a table tap as defined in claim 20, wherein the base station can control the volumes of the speaker and microphone of the table tap.

22. A monitor system using a table tap as defined in claim 4:

wherein said table tap further comprises a time-basis storage means for storing the power consumption detected by the power detection means, at every predetermined period of time; and said table tap transmits the detected power consumption stored in the time-basis storage means, together with the present power consumption detected by the power detection means, as information about detected power consumption, to the base station, at every predetermined period of time.

23. A monitor system using a table tap as defined in claim 22, wherein said base station stores the information about the detected power consumption and the ON/OFF time information, which are transmitted from the table tap.

24. A monitor system using a table tap as defined in claim 23, wherein said base station changes the set time and the set value of electric power which are parameters of the judgement condition set on the table tap, on the basis of the information about detected power consumption and the ON/OFF time information.

25. A monitor system using a table tap as defined in claim 22, wherein said table tap, after transmitting the information about detected power consumption and the ON/OFF time information, deletes the transmitted information from the time-basis storage means and the ON/OFF storage means, respectively.

26. A monitor system using a table tap as defined in claim 4:

wherein said table tap further comprises a time-basis storage means for storing the power consumption detected by the power detection means, at every predetermined period of time; and when there is a request from the base station, said table tap transmits the detected power consumption stored in the time-basis storage means, together with the present power consumption detected by the power detection means, as information about detected power consumption, to the base station.

27. A monitor system using a table tap as defined in claim 26, wherein said base station stores the information about the detected power consumption and the ON/OFF time information, which are transmitted from the table tap.

28. A monitor system using a table tap as defined in claim 27, wherein said base station changes the set time and the set value of electric power which are parameters of the judgement condition set on the table tap, on the basis of the information about detected power consumption and the ON/OFF time information.

29. A monitor system using a table tap as defined in claim 26, wherein said table tap, after transmitting the information about detected power consumption and the ON/OFF time information, deletes the transmitted information from the time-basis storage means and the ON/OFF storage means, respectively.

30. A monitor system using a table tap as defined in claim 4:

wherein said table tap further comprises an ON/OFF time storage means for detecting the times at which the connected electric appliance is switched on and off, and storing the result of the detection as ON/OFF time information; and when there is a request from the base station, said table tap transmits the ON/OFF time information to the base station.

31. A monitor system using a table tap as defined in claim 30, wherein said base station stores the information about the detected power consumption and the ON/OFF time information, which are transmitted from the table tap.

32. A monitor system using a table tap as defined in claim 31, wherein said base station changes the set time and the set value of electric power which are parameters of the judgement condition set on the table tap, on the basis of the information about detected power consumption and the ON/OFF time information.

33. A monitor system using a table tap as defined in claim 30, wherein said table tap, after transmitting the information about detected power consumption and the ON/OFF time information, deletes the transmitted information from the time-basis storage means and the ON/OFF storage means, respectively.

34. A monitor system using a table tap as defined in claim 4, wherein said table tap comprises:

at least two sockets into which electric appliances are plugged;

a time measurement means for measuring time;

a power detection means for detecting the amounts of power consumption of the respective electric appliances plugged in the respective sockets of the table tap; and a judgement means for integrally judging the respective amounts of power consumption detected by the power detection means, and deciding whether the result of the detection matches a predetermined judgement condition or not, with reference to time information measured by the time measurement means.

35. A monitor system using a table tap as defined in claim 34, wherein said table tap communicates with the base station when one of the amounts of power consumption detected by the power detection means matches the predetermined judgement condition.

36. A monitor system using a table tap as defined in claim 34, wherein said table tap communicates with the base station when at least two of the amounts of power consumption detected by the power detection means match the predetermined judgement conditions.

37. A monitor system using a table tap as defined in claim 4, wherein said table tap comprises:

a built-in power supply;

a power detection means for detecting a voltage supplied from a wall socket through a plug attached to the table tap; and a warning means, to which power is supplied from the power supply, for outputting a beep sound when the power detection means detects that the plug is disconnected from the wall socket.

38. A monitor system using a table tap as defined in claim 37 wherein, when the plug is disconnected from the wall socket, said table tap detects this at the power detection means, and communicates with the base station.

39. A monitor system using a table tap as defined in claim 37 wherein, when the plug of the table tap is disconnected from the wall socket, said table tap detects this at the power detection means and, if the plug is not inserted in the wall socket by a predetermined time, said table tap communicates with the base station.

40. A monitor system using a table tap as defined in claim 4, wherein said table tap further comprises a switch for inhibiting communication with the base station.

41. A monitor system with a table tap as defined in claim 40, wherein said table tap notifies the base station that the switch for inhibiting communication is turned on or off.

42. A monitor system using a table tap as defined in claim 40, wherein said table tap further comprises:

a storage means for storing the time when the switch for inhibiting communication is turned off; and a warming means for outputting a beep when the switch is not turned on even when a predetermined time has passed from the time stored in the storage means.

43. A monitor system using a table tap as defined in claim 3, wherein said table tap communicates with the base station when there is no variation in the power consumption detected by the power detection means for more than a predetermined period of time.

44. A monitor system using a table tap as defined in claim 3, wherein said table tap communicates with the base station when there is no variation in the power consumption detected by the power detection means within a predetermined period of time.

45. A monitor system using a table tap as defined in claim 3, wherein said table tap communicates with the base station when the power detection means cannot detect a predetermined amount of electric power within a predetermined period of time.

46. A monitor system using a table tap as defined in claim 3, wherein said table tap communicates with the base station when the power detection means cannot detect a predetermined amount of electric power at a predetermined time.

47. A monitor system using a table tap as defined in claim 3, wherein said table tap communicates with the base station when the power detection means continues to detect a predetermined amount of electric power even after a predetermined time has passed.

48. A monitor system using a table tap as defined in claim 3, wherein said table tap communicates with the base station when the power detection means cannot detect a predetermined amount of electric power at a predetermined time on a predetermined day of the week.

49. A monitor system using a table tap as defined in claim 3 wherein said table tap further comprises:

a judgement condition setting means for setting, according to the user of the electric appliance, at least two judgement conditions among the following six judgement conditions:

a first judgement condition that the power consumption detected by the power detection means has no variation for more than a predetermined period of time;

a second judgement condition that the power consumption detected by the power detection means has no variation within a predetermined period of time;

a third judgement condition that the power detection means cannot detect a predetermined amount of electric power within a predetermined period of time;

a fourth judgement condition that the power detection means cannot detect a predetermined amount of electric power at a predetermined time;

a fifth judgement condition that the power detection means continues to detect a predetermined amount of electric power even after a predetermined time has passed; and a sixth judgement condition that the power detection means cannot detect a predetermined amount of electric power at a predetermined time on a predetermined day of the week; and said table tap communicates with the base station when one of the two or more judgement conditions is satisfied.

50. A monitor system using a table tap as defined in claim 49 further comprising a parameter selection means for selecting a set time and a set value of electric power which are parameters required to set the first to sixth judgement conditions.

51. A monitor system using a table tap as defined in claim 49 further comprising a parameter input means for inputting a set time and a set value of electric power which are parameters required to set the first to sixth judgement conditions.

52. A monitor system using a table tap as defined in claim 3 wherein said table tap further comprises:

a judgement condition setting means for setting at least two judgement conditions among the following six judgement conditions:

a first judgement condition that the power consumption detected by the power detection means has no variation for more than a predetermined period of time;

a second judgement condition that the power consumption detected by the power detection means has no variation within a predetermined period of time;

a third judgement condition that the power detection means cannot detect a predetermined amount of electric power within a predetermined period of time;

a fourth judgement condition that the power detection means cannot detect a predetermined amount of electric power at a predetermined time;

a fifth judgement condition that the power detection means continues to detect a predetermined amount of electric power even after a predetermined time has passed; and a sixth judgement condition that the power detection means cannot detect a predetermined amount of electric power at a predetermined time on a predetermined day of the week; and a judgement condition switch means for selecting, from the set judgement conditions, a judgement condition on which the table tap communicates with the base station.

53. A monitor system using a table tap as defined in claim 52 further comprising a parameter selection means for selecting a set time and a set value of electric power which are parameters required to set the first to sixth judgement conditions.

54. A monitor system using a table tap as defined in claim 52 further comprising a parameter input means for inputting a set time and a set value of electric power which are parameters required to set the first to sixth judgement conditions.

55. A monitor system using a table tap as defined in claim 3, wherein said table tap further comprises:

time-basis storage means for storing the power consumption detected by the power detection means, at every predetermined period of time; and comparison means for comparing the power consumption stored in the time-basis storage means with the power consumption which is actually detected; and said table tap communicates with the base station when the result of the comparison by the comparison means indicates a difference larger than a predetermined value.

56. A monitor system using a table tap as defined in claim 55, wherein said table tap further comprises a detection result updation means for updating the detected power consumption stored in the time-basis storage means.

57. A monitor system using a table tap as defined in claim 55:

wherein said table tap further comprises a detection result updation means for obtaining a weighted average between the detected power consumption stored in the time-basis storage means and the actually detected power consumption, at every corresponding period of time; and said table tap stores the result of the weighted averaging in the time-basis storage means as updated power consumption at every predetermined period of time.

58. A monitor system using a table tap as defined in claim 3, wherein said table tap comprises:

a built-in power supply;

a power detection means for detecting a voltage supplied from a wall socket through a plug attached to the table tap; and a warning means, to which power is supplied from the power supply, for outputting a beep sound when the power detection means detects that the plug is disconnected from the wall socket.

59. A monitor system using a table tap as defined in claim 58 wherein, when the plug is disconnected from the wall socket, said table tap detects this at the power detection means, and communicates with the base station.

60. A monitor system using a table tap as defined in claim 58 wherein, when the plug of the table tap is disconnected from the wall socket, said table tap detects this at the power detection means and, if the plug is not inserted in the wall socket by a predetermined time, said table tap communicates with the base station.

61. A monitor system using a table tap as defined in claim 3, wherein said table tap further comprises a switch for inhibiting communication with the base station.

62. A monitor system with a table tap as defined in claim 61, wherein said table tap notifies the base station that the switch for inhibiting communication is turned on or off.

63. A monitor system using a table tap as defined in claim 61, wherein said table tap further comprises:

a storage means for storing the time when the switch for inhibiting communication is turned off; and a warming means for outputting a beep when the switch is not turned on even when a predetermined time has passed from the time stored in the storage means.

* * * * *